US006041559A

United States Patent [19]

Schickert et al.

[11] Patent Number: 6,041,559

[45] **Date of Patent: *Mar. 28, 2000**

[54] MOUNTING STRUCTURE FOR SUPPORTING A BASKETBALL POLE

[75] Inventors: Randy R. Schickert, Kewaskum; Ronald A. White, N. Prairie, both of Wis.

[73] Assignee: Huffy Corporation, Miamisburg, Ohio

[ * ] Notice: This patent is subject to a terminal disclaimer.

[21] Appl. No.: 08/974,467

[22] Filed: Nov. 20, 1997

Related U.S. Application Data

[63] Continuation-in-part of application No. 08/743,536, Nov. 4, 1996, Pat. No. 5,752,349, which is a continuation of application No. 08/313,360, Sep. 27, 1994, Pat. No. 5,571,229.

[51] Int. Cl.[7] ..... E02D 5/80; A63B 63/08

[52] U.S. Cl. ..... 52/165; 52/40; 52/298; 248/156; 273/407

[58] Field of Search ..... 52/40, 165, 156, 52/170, 298, 704, 726.3, 726.4, 736.4; 273/407; 248/519, 523, 530, 545, 156, 158, 411–413

[56] References Cited

U.S. PATENT DOCUMENTS

| | | | |
|---|---|---|---|
| 87,015 | 2/1869 | Varian . | |
| D. 139,311 | 10/1944 | Gibson . | |
| 225,683 | 3/1880 | Brady . | |
| 405,658 | 6/1889 | Campany | 52/170 |
| 432,043 | 7/1890 | Heiland . | |
| 592,660 | 10/1897 | Miller . | |
| 753,709 | 3/1904 | Jones . | |
| 837,820 | 12/1906 | Folsom et al. . | |
| 877,268 | 1/1908 | Van Buren | 52/170 |
| 982,380 | 1/1911 | Martin . | |
| 1,095,197 | 5/1914 | Entenmann . | |
| 1,564,109 | 12/1925 | Ponsolle . | |
| 1,611,935 | 12/1926 | Mitchell . | |
| 1,799,314 | 4/1931 | Pfaff . | |
| 2,194,779 | 3/1940 | Albach . | |
| 2,888,111 | 5/1959 | Evans . | |
| 2,945,659 | 7/1960 | McDonald . | |
| 3,170,721 | 2/1965 | Wells et al. . | |
| 3,339,869 | 9/1967 | Andersen | 248/156 X |
| 3,342,444 | 9/1967 | Nelson . | |
| 3,417,525 | 12/1968 | Dashio . | |
| 3,544,110 | 12/1970 | Dickinson . | |
| 3,767,355 | 10/1973 | Anderson | 248/156 X |
| 3,843,079 | 10/1974 | Reisling . | |
| 4,133,154 | 1/1979 | Ruzicka . | |
| 4,307,887 | 12/1981 | Weiss . | |
| 5,037,093 | 8/1991 | Roark . | |
| 5,039,043 | 8/1991 | Hodge | 248/411 |
| 5,090,165 | 2/1992 | Kenny . | |
| 5,316,315 | 5/1994 | Roark . | |
| 5,337,989 | 8/1994 | Apple . | |
| 5,417,511 | 5/1995 | Warden . | |
| 5,492,429 | 2/1996 | Hodges . | |
| 5,535,978 | 7/1996 | Rodriguez et al. | 248/523 X |
| 5,571,229 | 11/1996 | Fitzsimmons et al. . | |
| 5,752,349 | 5/1998 | Fitzsimmons et al. | 52/165 |
| 5,869,151 | 2/1999 | Chong | 248/519 X |
| 5,901,525 | 5/1999 | Dperinger et al. | 248/519 X |

*Primary Examiner*—Robert Canfield
*Attorney, Agent, or Firm*—Howrey & Simon; Michael J. Bell; Andrew R. Kopsidas

[57] ABSTRACT

A mounting structure for supporting a removable basketball support pole in the ground. In a first embodiment, the mounting structure may include a sleeve body, a clamping mechanism and a cap. The sleeve body has an open end of a predetermined size for receiving the basketball pole. The open end of the sleeve has relief portions, such as grooves, for providing flexibility to permit deformation of the open end of the sleeve to adjust to the size of the basketball pole. The clamping mechanism then may be used to engage the sleeve with the pole and securely support the basketball pole in position. In another embodiment, the clamping mechanism is unnecessary as a portion of the cap forms a wedge. In particular, the cap may include the relief portions and the sleeve has a camming surface whereby a portion of the cap wedges between the camming surface and the pole when the cap is tightened onto the sleeve. In yet another embodiment of the invention, the ground sleeve may include a four-piece construction that is capable of assembly in either a compact arrangement or an assembled arrangement. This four-piece construction may also include relief portions, a clamping mechanism and a cap similar to the first embodiment.

33 Claims, 18 Drawing Sheets

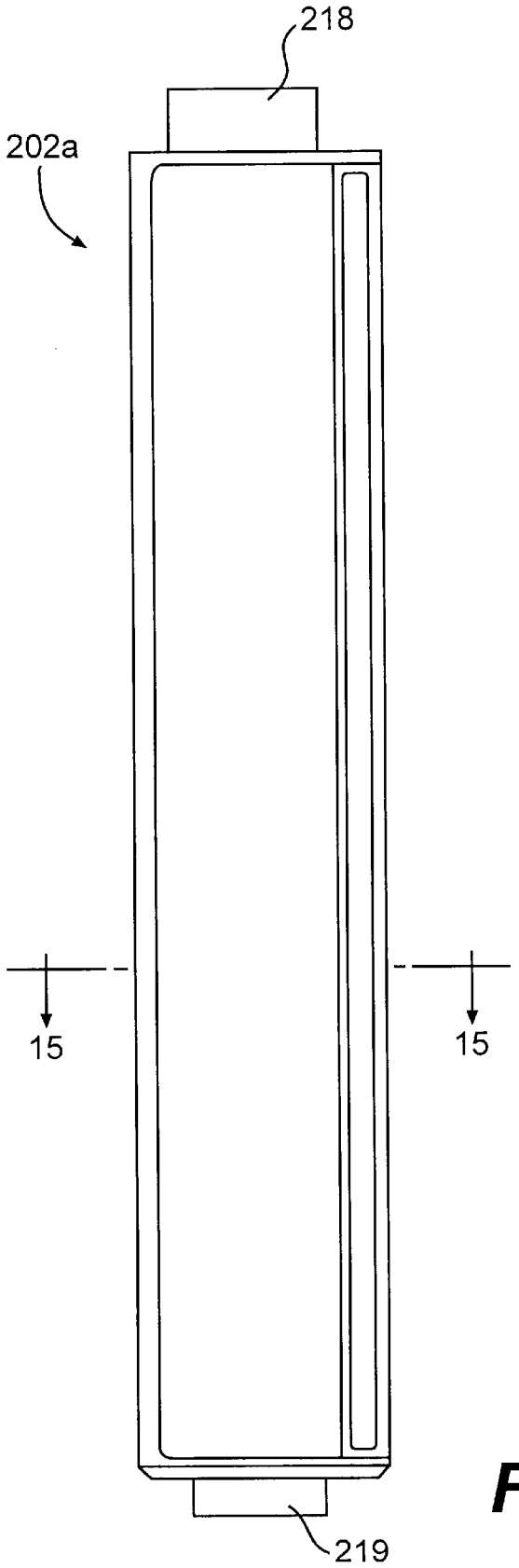
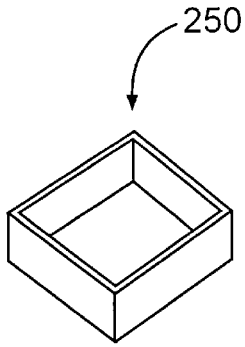
FIG. 16
FIG. 14

MOUNTING STRUCTURE FOR SUPPORTING A BASKETBALL POLE

This application is a continuation-in-part of application Ser. No. 08/743,536 filed on Nov. 4, 1996, now U.S. Pat. No. 5,752,349, which is a continuation of application Ser. No. 08/313,360 filed Sep. 27, 1994, now U.S. Pat. No. 5,571,229. The disclosure of application Ser. No. 08/743,536 and U.S. Pat. No. 5,571,229 are incorporated herein by reference.

BACKGROUND OF THE INVENTION

1. Field of the Invention

This invention relates to a mounting structure for supporting a basketball pole or the like. More particularly, the invention relates to a ground sleeve having a deformable open end to accommodate insertion and removable of a square-shaped basketball pole and, alternatively, to a four-piece ground sleeve that has a compact shipping arrangement.

2. Description of Related Art

Pole support systems for supporting poles in an upright, vertical position have been available in a number of industries. For example, in the electric pole industry, metal support stands have been used to mount telephone poles, for example, of the type described in U.S. Pat. No. 982,380 to Martin.

However, the basketball industry is somewhat different from, for example, the electric pole industry because mounting a basketball pole requires additional/different considerations such as consumer assembly, removal and stability during rough play. For example, it is desirable to secure a basketball support pole for a free-standing backboard and goal assembly as rigidly as possible in the ground to minimize or dampen out vibrations that are generated by a basketball striking the backboard and/or the support pole. Toward this objective, a lower end of a free-standing, basketball support pole typically has been encased in cement, asphalt or the like in the ground adjacent the playing surface while an upper end of the support pole supports the backboard assembly secured thereto. Thus, the pole is securely maintained in a fixed and erect position.

One result of providing a rigidly fixed free standing support pole in this manner is that the support pole is effectively permanently secured within the ground such that subsequent removal thereof is time and labor intensive. However, there are a number of instances where removal and/or replacement of the support pole from the ground is desirable. For instance, during long periods of inclement weather, the support pole, typically made from cast iron, steel or aluminum tubing (hereinafter referred to as "metal"), is susceptible to rusting and/or corrosion which deteriorates the appearance and eventually the structural integrity of the metal support pole. Also, the pole may become damaged by vehicles parking in close proximity to the pole, or by stresses induced during play. In any case, it is generally desirable to removably mount the support pole in the ground. With the in-ground cement mounting system, the pole cannot be moved without breaking up and removing the concrete "slug" from the pole and starting over. Thus, other ways to mount a basketball pole have been attempted.

One known way to mount a basketball support pole in the ground is through the use of a metal ground sleeve positioned on the end of the pole prior to installation into the concrete. One type of sleeve is for use with a square pole and is of a two-piece construction utilizing wedges to stabilize the pole in the sleeve. Another type is for use with a round pole and is of a single piece cylindrical shape having a locking tab for stabilizing the pole in the ground sleeve. Although these systems are designed for removability, the sleeve and pole are both metal and make flush metal-to-metal contact for most of their surfaces that are in contact. This connection can lead to corrosion and surface friction, which make pole removal difficult.

Therefore, what is needed is a ground sleeve that is weather and corrosion resistant, accommodates manufacturing tolerances, and is removably secured to the pole to support the pole in a rigid upright position. Moreover, there is a need for a ground sleeve that helps guide or position the pole in the ground sleeve, yet does not compromise removability of the pole. Furthermore, a ground sleeve that can be shipped in a compact nested shipping arrangement would provide certain advantages. U.S. Pat. No. 5,571,229, assigned to the assignee of this application, provides solutions to many of these problems for a round pole, while this patent application provides solutions for a square or generally square-shaped pole. However, the features of both may be incorporated into a variety of different shaped ground sleeves to accommodate varying shaped poles.

SUMMARY OF THE INVENTION

The invention solves the above-mentioned problems and avoids the drawbacks and disadvantages of the prior art by providing a mounting system for supporting a basketball pole, particularly a pole having a square or generally square cross-section in which the upper end is deformable.

In one embodiment, the mounting system may include a ground sleeve, a clamping mechanism and a cap. The ground sleeve may be of the type having a tubular construction with a open end for receiving the lower end of the pole therethrough. The open end is made of a deformable material or construction to adjust for variations in pole size. In one embodiment of the invention, the open end of the ground sleeve is made deformable by varying its thickness. For example, at least one relief portion may be formed in the open end of the ground sleeve, which may include a groove, notch or otherwise. Accordingly, the pole can be easily inserted into and removed from the ground sleeve. Then the clamping mechanism can be used to secure the open end of the ground sleeve to the pole. Moreover, to aid in the removability of the pole, a main body of the ground sleeve may be formed with a larger diameter than the pole such that surface contact between the exterior surface of the pole and the interior surface of the ground sleeve is minimized. However, to aid in the insertion of the pole into the ground sleeve, as well as, to more rigidly support the pole in the ground sleeve, the ground sleeve may include pole support and alignment portions. For example, the sidewalls of the ground sleeve may include portions that extend inwardly from the sidewall that are intended to come into contact with the pole to help rigidly support the pole. In addition, tapered portions at the bottom end of the ground sleeve may be included to center and/or align the pole within the ground sleeve. A cap may be used to cover the clamping mechanism and the exposed end of the ground sleeve.

In another embodiment of the invention, the ground sleeve may be formed with a tapered camming surface and the cap is deformable. For example, the cap may include relief portions such as grooves or notches that allow the cap to deform upon engagement with the tapered camming surface of the ground sleeve. By tightening the cap onto the ground sleeve, the deformable portion of the cap deflects against the camming surface of the ground sleeve and wedges between the camming surface of the ground sleeve and the exterior of the pole to secure the pole in the mounting system.

In yet another embodiment of the invention, the mounting system can include a multi-section ground sleeve, which may be shipped in a compact arrangement by nesting the sections of the ground sleeve within each other.

BRIEF DESCRIPTION OF THE DRAWINGS

FIG. 14 is a side view of one section of the four-piece ground sleeve shown in FIG. 12.

FIG. 16 is a perspective view of the lower end cap shown in FIG. 12.

Other features and advantages of the invention will be apparent from the following detailed description, the accompanying drawings and the appended claims.

DETAILED DESCRIPTION OF PREFERRED EMBODIMENTS

The invention relates to a mounting system for a basketball system of the type that is mounted in the ground using a ground sleeve particularly adapted for removably mounting a basketball support pole having a square or generally square-shaped cross-section. FIGS. 1–6E illustrate a first embodiment of the invention having a ground sleeve with relieved sides to accommodate variances in pole size, reduce surface friction and facilitate pole removal. FIGS. 7–11 illustrate a second embodiment of the invention, that use a cap with relieved sides and a camming feature to achieve these objectives. FIGS. 12–16 illustrate a third embodiment of the invention, employing a four-piece ground sleeve, while FIGS. 17–20 illustrate a fourth embodiment, similar to the third. Each embodiment will be discussed in detail in the following.

A First Embodiment of the Invention

Figure 1:
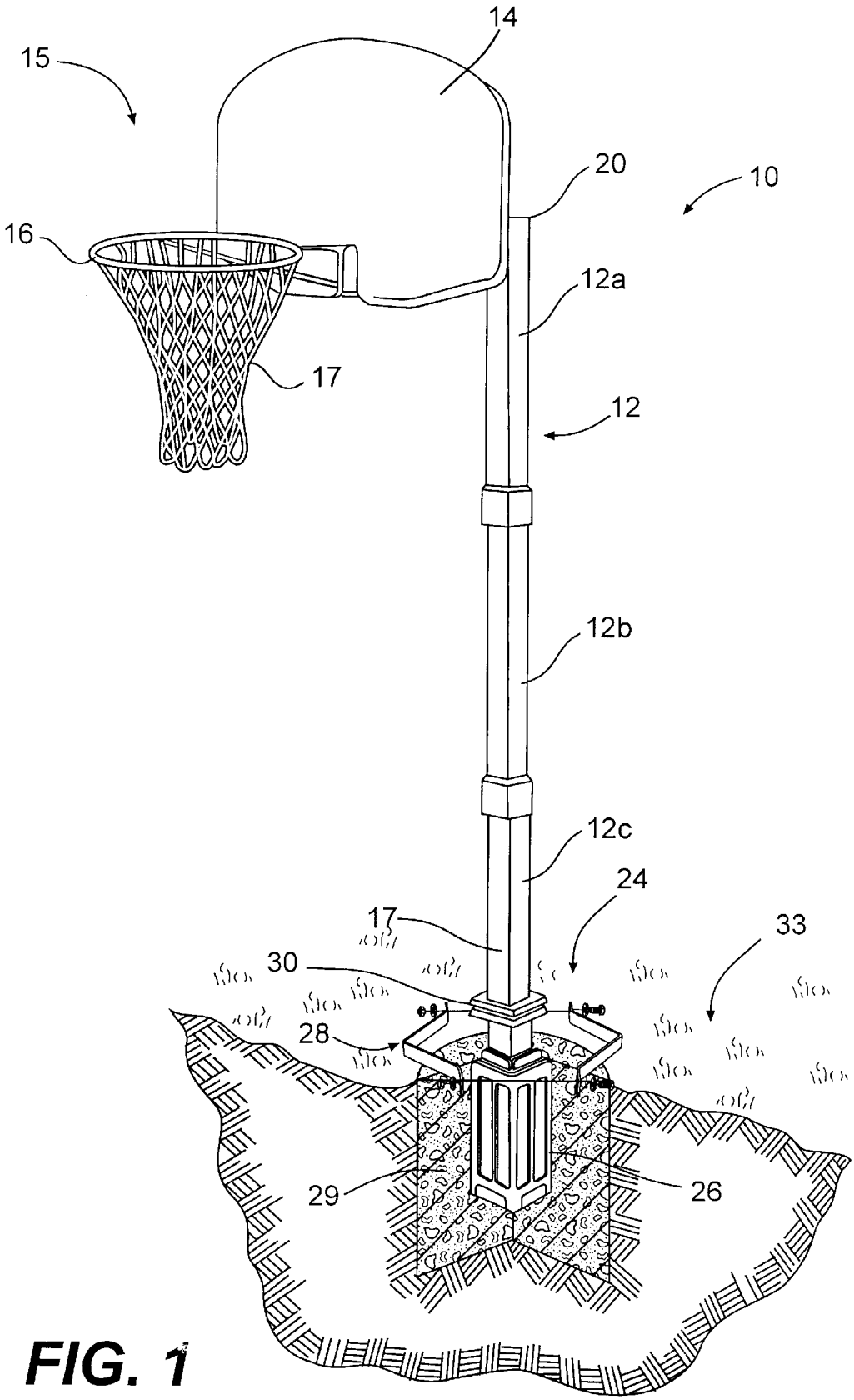
FIG. 1 is a partially exploded perspective view of a basketball system mounted in the ground with a mounting system constructed according to the principles of a first embodiment of the invention.

Referring now to FIG. 1, a basketball system shown generally at 10 is typical of the type that may be mounted in the ground 33 using cement 29. Basketball system 10 may be of any conventional type and generally includes a goal and net assembly 15, a support pole 12 and a mounting system 24.

Pole 12 is a generally elongated member with an upper end 20 and a lower end 17. Goal assembly 15 typically is mounted on upper end 20 of pole 12 by conventional support arms (not shown) and includes a backboard 14, goal 16 and net 17. Any conventional goal assembly may be used in accordance with the invention. Pole 12 may be formed from any durable material such as metal. Pole 12 as shown is a conventional basketball pole having a height of approximately fourteen (14) feet and square cross-section of, e.g., four inches by four inches. Pole 12 may be formed in three sections 12*a*, 12*b* and 12*c* for compact shipping. The upper two pole sections 12*a* and 12*b* each have an expanded or enlarged lower end such that pole sections 12*a*, 12*b*, 12*c* may be assembled together using a friction type fitting or other connection method known in the art. The construction and assembly of pole 12 is well-known and other types of pole constructions may be used. Although the mounting system of the invention is particularly adapted for square or generally square-shaped poles, different shaped poles may be used, for example, rectangular, pear shaped, asymmetrical or the like, with appropriate modifications being made to the mounting system. For example, a particularly advantageous mounting system for a circular cross-section pole is described in the assignee's prior U.S. Pat. No. 5,571,229 and application Ser. No. 08/743,536, the disclosures of which are incorporated by reference herein.

Figure 2:
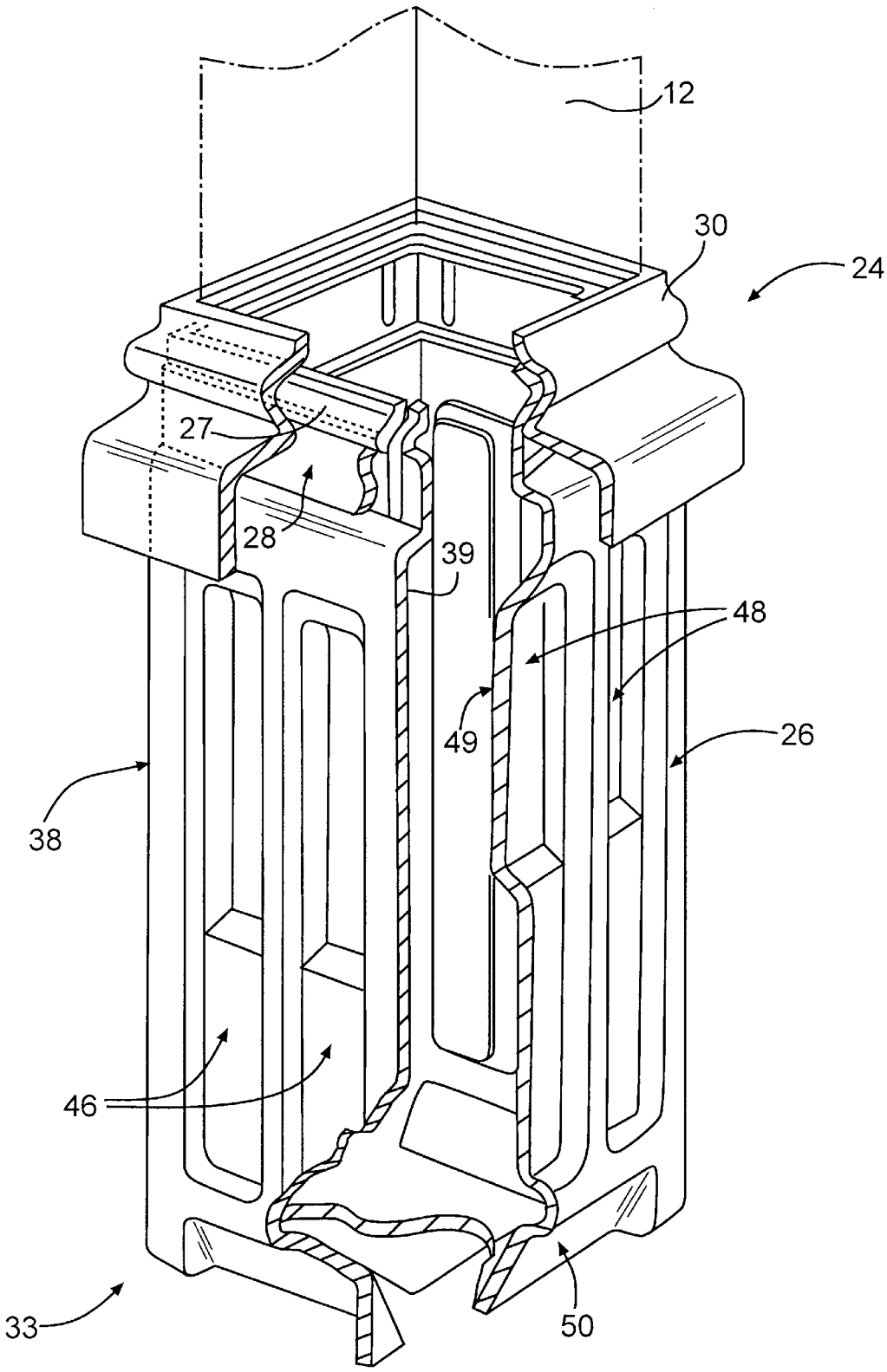
FIG. 2 is a perspective partial cut-away view of the mounting system shown in FIG. 1.

Mounting system 24 of the invention may include a ground sleeve 26, a clamping mechanism 28, and a cap 30, which together form a ground sleeve assembly as shown in an exploded view in FIG. 1. An assembled view of mounting system 24 is shown in FIG. 2. In the following discussion, the details of the construction of the ground sleeve 26 (FIGS. 3A–5), clamping mechanism 28 (FIG. 6A), and cap 30 (FIGS. 6B–6C) will be described individually. Then the operation and use of mounting system 24 will be discussed. Finally, a preferred method of making ground sleeve 26 and cap 30 will be discussed with reference to FIG. 6D. An alternate embodiment for the ground sleeve is illustrated in FIG. 6E.

Referring to FIGS. 3A, 3B, 4 and 5, ground sleeve 26 generally includes a semi-rigid body 38 with a deformable neck 36. As discussed in detail later, semi-rigid body 38 is configured to removably support basketball pole 12 in an upright, rigid position within ground sleeve 26 and deformable neck 36 is configured to be removably secured to pole 12.

Ground sleeve 26 preferably is of a unitary construction formed using a conventional blow-molding process as discussed in more detail below. Ground sleeve 26 may be made from any semi-rigid material such as polyethylene or a high density black polypropylene, which has the advantage of being inherently resistant to ultraviolet rays. In accordance with the invention, neck 36 is made deformable and body is 38 is made more rigid by varying the structure of ground sleeve 26 as discussed below. However, the deformability and rigidity may be varied in other ways that will be apparent to those of skill in the art such as by using different materials or by varying the thickness of the materials. Accordingly, the invention is not limited to a particular type of material.

Neck 36 has four side walls 37 (FIG. 3B) defining an open end 34 for passing pole 12 therethrough. The four side walls 37 of neck 36 define inner dimensions only slightly larger than the outer dimensions of pole 12 such that pole 12 may be easily passed therethrough, yet without requiring extensive deformation to secure neck 36 to pole 12, as discussed later. For example, the inner dimensions of neck 36 may be approximately 4 1/16–4 1/8" square when used with a nominal 4" square pole.

Neck portion 36 further includes relief grooves 40 to allow neck portion 36 to deform and deflect upon insertion and removal of pole 12, as well as, to allow neck portion 36 to be sufficiently deformable so that it can be securely tightened onto pole 12 by clamping mechanism 28, described below. As shown, relief grooves 40 may be thin slits formed in neck portion 36 that extend longitudinally from open end 34 to just short of body 38. As illustrated in the cross-sectional view of neck 36 in FIG. 3B, a pair of relief grooves 40 may be formed in each of the four corners of neck 36 of ground sleeve 26. Relief grooves 40 may have a width of about 1/8" and a height of about 1 5/8", for example. However, any structure that allows deformation of neck portion 36 in accordance with the principles of the invention may be used. Moreover, other arrangements, quantities and configurations of relief grooves 40 may be used in accordance with the invention.

At open end 34 of neck 36 is formed a peripheral protuberance or rib 27, when viewed from the exterior of ground sleeve 26 (FIG. 3A), which is used for attaching cap 30 to ground sleeve 26 as discussed in greater detail herein. As shown in FIG. 2, protuberance 27 may have a generally u-shaped cross-section.

Ground sleeve body 38 also may be square in cross-section and has four side walls 44 defining a body cavity 35. The interior space generally defined by side walls 44 is sufficiently larger than the exterior of pole 12 such that when pole 12 is disposed in body cavity 35 of ground sleeve 26, smaller cavities or air spaces 39 remain between a significant portion of the exterior of pole 12 and the interior of ground sleeve body 38. When used with a 4" square pole, body 38 may be about 3/8–4 1/2" square. This remaining space 39 minimizes the amount of surface contact between pole 12 and ground sleeve 26, thereby facilitating pole insertion and removal because frictional contact therebetween is reduced as discussed in more detail below. However, the size and/or configuration of remaining spaces 39 may vary due to the addition of structure to increase the rigidity of body 38. For example, the interior of side walls 44 need not be entirely out of contact with the exterior of pole 12 in accordance with the invention. Some contact between the interior of side walls 44 and the exterior of pole 12 is beneficial to provide pole support and reinforcement during use.

Because neck 36 of ground sleeve 26 is of a smaller dimension than body 38, a shoulder 42 (FIG. 3A) is formed in the transition therebetween. Shoulder 42 provides: rigidity and increased structural integrity to ground sleeve 26; serves as a reference point for mounting clamping mechanism 28 thereon; and serves as a measurement guide during installation, for example, ground sleeve 26 is preferably sunk in cement 29 only up to shoulder 42. If ground sleeve 26 is, for example, 16–17" in total height, to support pole 12, body 38 would preferably have a height of 14" such that 14" of ground sleeve 26 would be set in cement 29.

Figure 3A:
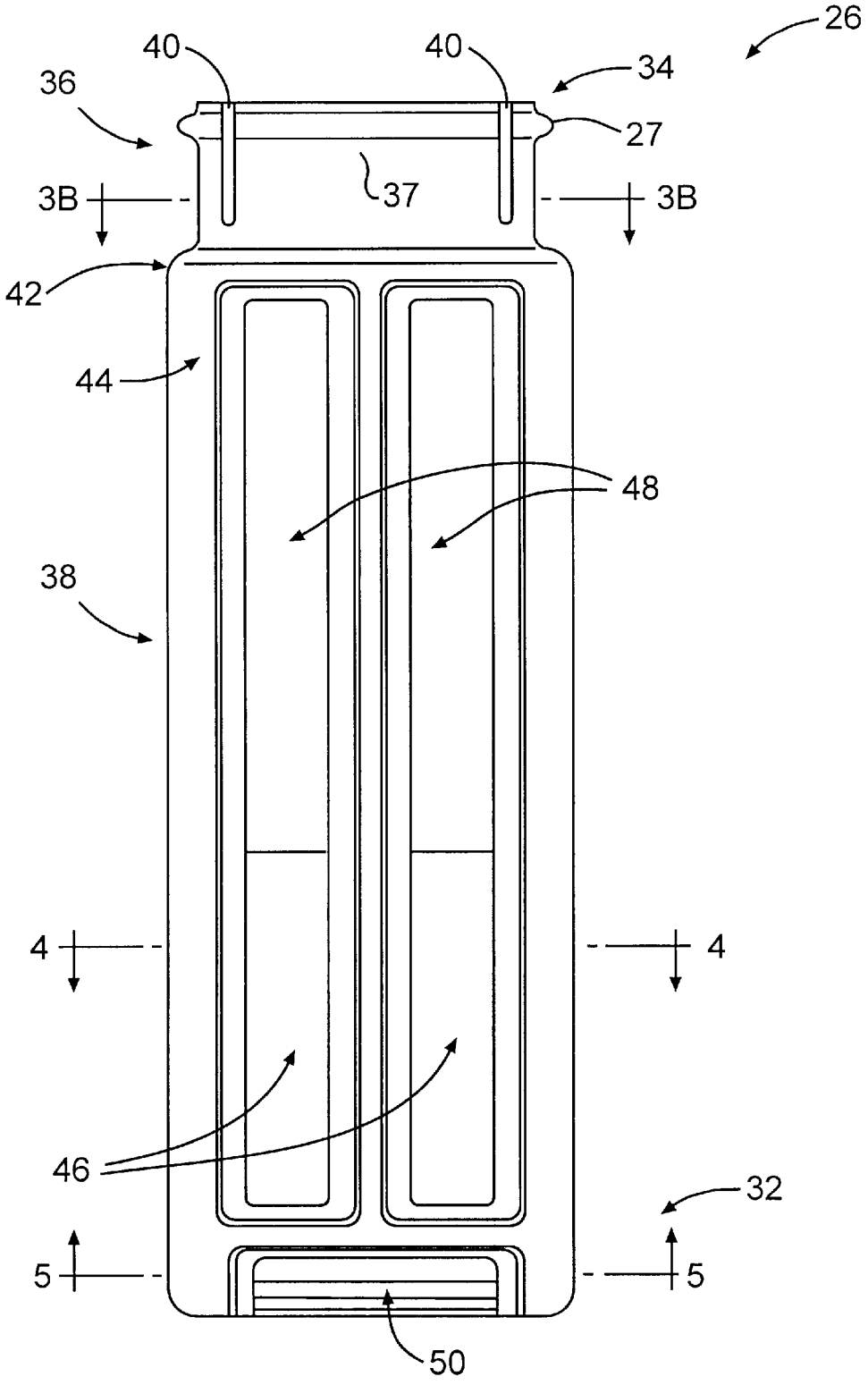
FIG. 3A is a side view of the ground sleeve of the mounting system in accordance with the first embodiment of the invention.
Figure 3B:
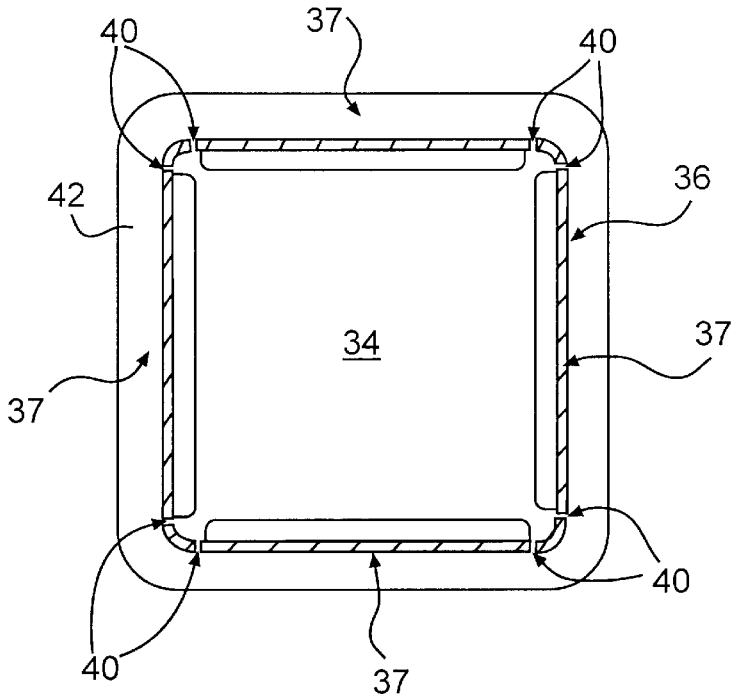
FIG. 3B is a cross-sectional view taken along line 3B—3B in FIG. 3A.
Figure 4:
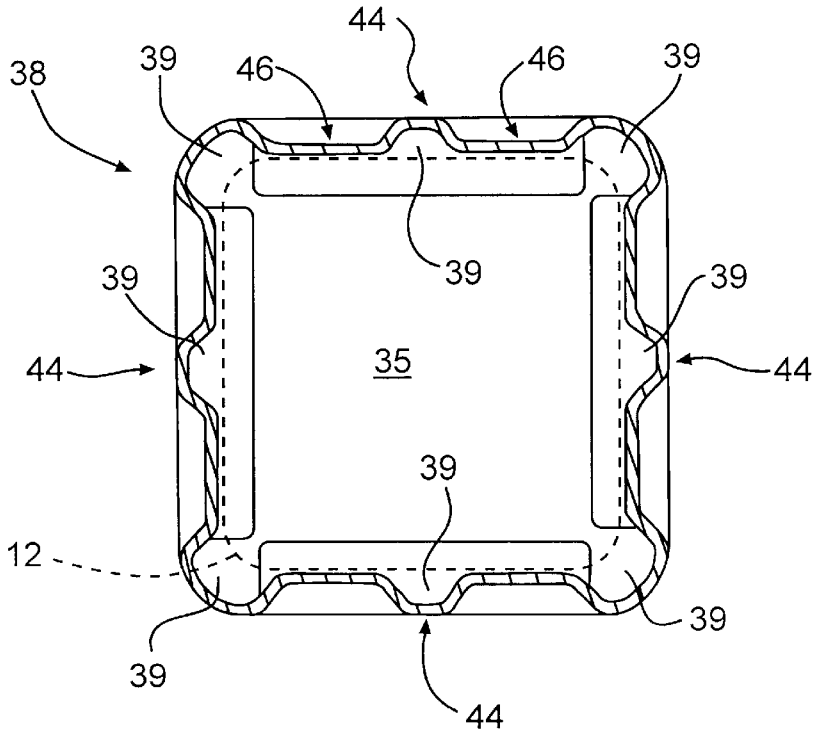
FIG. 4 is a cross-sectional view taken along line 4—4 in FIG. 3A.
Figure 5:
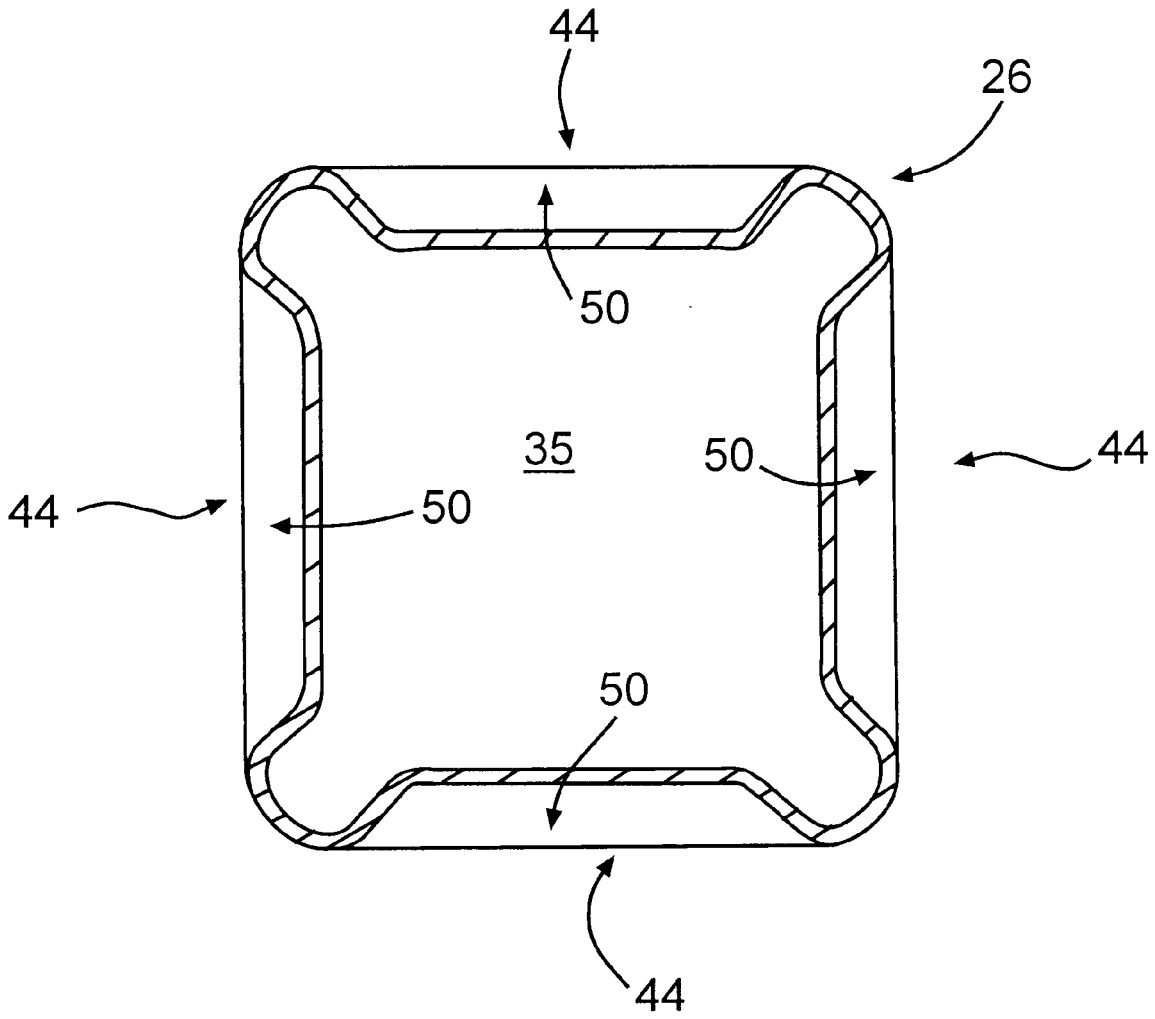
FIG. 5 is a cross-sectional view taken along line 5—5 in FIG. 3A.

Although body 38 of ground sleeve 26 preferably is formed to have its interior dimensions larger than the exterior dimensions of pole 12, body 38 may be configured in a manner to increase the structural rigidity of body 38 and anchor ground sleeve 26 in ground 33. For example, body 38 may include a pair of columns 46 formed in each of side walls 44 as shown in FIG. 3A. In particular, columns 46, when viewed from the exterior of ground sleeve 26, extend inwardly in a radial direction into cavity 35 as shown in cross-section in FIG. 4. Thus, columns 46 may be formed as indentations that extend longitudinally between closed end 32 of ground sleeve 26 and shoulder 42 of ground sleeve 26. Columns 46 may have a substantially trapezoidal cross-sectional shape as shown in FIGS. 2 and 4. Columns 46 may have a depth of approximately 1/4 of an inch so as to avoid contact with pole 12. In use, when ground sleeve 26 is sunk in cement 29, cement 29 fills columns 46 to create an undercut which makes it more difficult to remove ground sleeve 26 from concrete 29 and prevents rotation of ground sleeve 26 in concrete 29. However, other configurations apparent to one skilled in the art may be used to increase the structural rigidity of body 38 and anchor ground sleeve 26 in accordance with the invention.

For example, body 38 may further include pole support side portions 48 formed above columns 46 and alignment bottom portions 50 to align pole 12 in a substantially central, upright, rigid, and vertical position within ground sleeve 26. In particular, pole support portions 48 (FIG. 2) are formed as deeper indentations than columns 46 so as to abut the exterior of pole 12 and assist in rigidly supporting pole 12 during use. Pole support portions 48 form interior pole abutment surfaces 49 to support and stabilize pole 12 in position with ground sleeve 26. A plurality of pole support portions 48 are positioned above the columns 46 and extend circumferentially around body 38 thereby surrounding pole 12 when it is disposed within body 38 of ground sleeve 26. Thus, in combination, abutment surfaces 49 form a narrowed portion along ground sleeve 26 that is only slightly larger than pole 12. The height of pole support portions 48 may be, for example, one-third to two-thirds the height of each column 46. The size of pole support portions 48 may be increased to increase the rigidity of pole 12 during use. For example, as illustrated in the modification shown schematically in FIG. 6E, pole support portions 48 may be enlarged as shown at 48' to increase the width of the interior abutment surfaces 49, thereby increasing the rigidity and stability of pole 12 during use. Thin elongated ribs 47 optionally may be provided for increasing the rigidity of enlarged support portions 48'.

Alignment portions 50 (FIGS. 2, 3A and 5) may be provided in bottom wall 31 of closed end 32 of ground sleeve 26 to further position, align and support pole 12 within cavity 35 of body 38. Alignment portions 50 as shown best in FIG. 2 include tapered portions which extend from side walls 44 inwardly and downwardly toward bottom wall 31. Lower end 17 of pole 12 engages alignment portions 50 to facilitate disposition of pole 12 in the center of cavity 35 of body 38 of ground sleeve 26, as well as to more rigidly support pole 12 in ground sleeve 26 during use by providing lateral support for lower end 17 of pole 12. Although alignment portions 50 and pole support portions 48 serve as guides in aligning pole 12 within ground sleeve 26, it is still necessary to use a level or similar device to position the combination of pole 12 and ground sleeve 26 in a vertical disposition in the ground.

Clamping mechanism 28 may take the form of any structure, such as a mechanical device, that is capable of clamping or cinching deformable neck 36 to pole 12. For strength, clamping mechanism 28 is preferably made of metal. As illustrated in the example shown in FIG. 6A, clamping mechanism 28 may include a pair of right angle brackets 53 each having a flange 54 on either end. Each flange 54 includes an aperture 55 to receive connectors 58. As illustrated, connectors 58 may include bolts 60, washers 62, nuts 64 or other fastening devices known in the art. The invention is not limited to a particular type of device to secure neck 36 to pole 12.

As illustrated by FIGS. 1 and 3, in use, brackets 53 are positioned around neck 36 of the ground sleeve above shoulder 42. By tightening connectors 58, brackets 53 are moved toward each other, causing deformable neck 36 of ground sleeve 26 to flex against the exterior of pole 12 by virtue of the relief structure provided on neck 36. Connectors 58 may be tightened until pole 12 is securely fastened within ground sleeve 26. Pole support portions 48 and alignment portions 50 act in concert with clamped neck 36 to rigidly support pole 12 within ground sleeve 26.

Figure 6A:
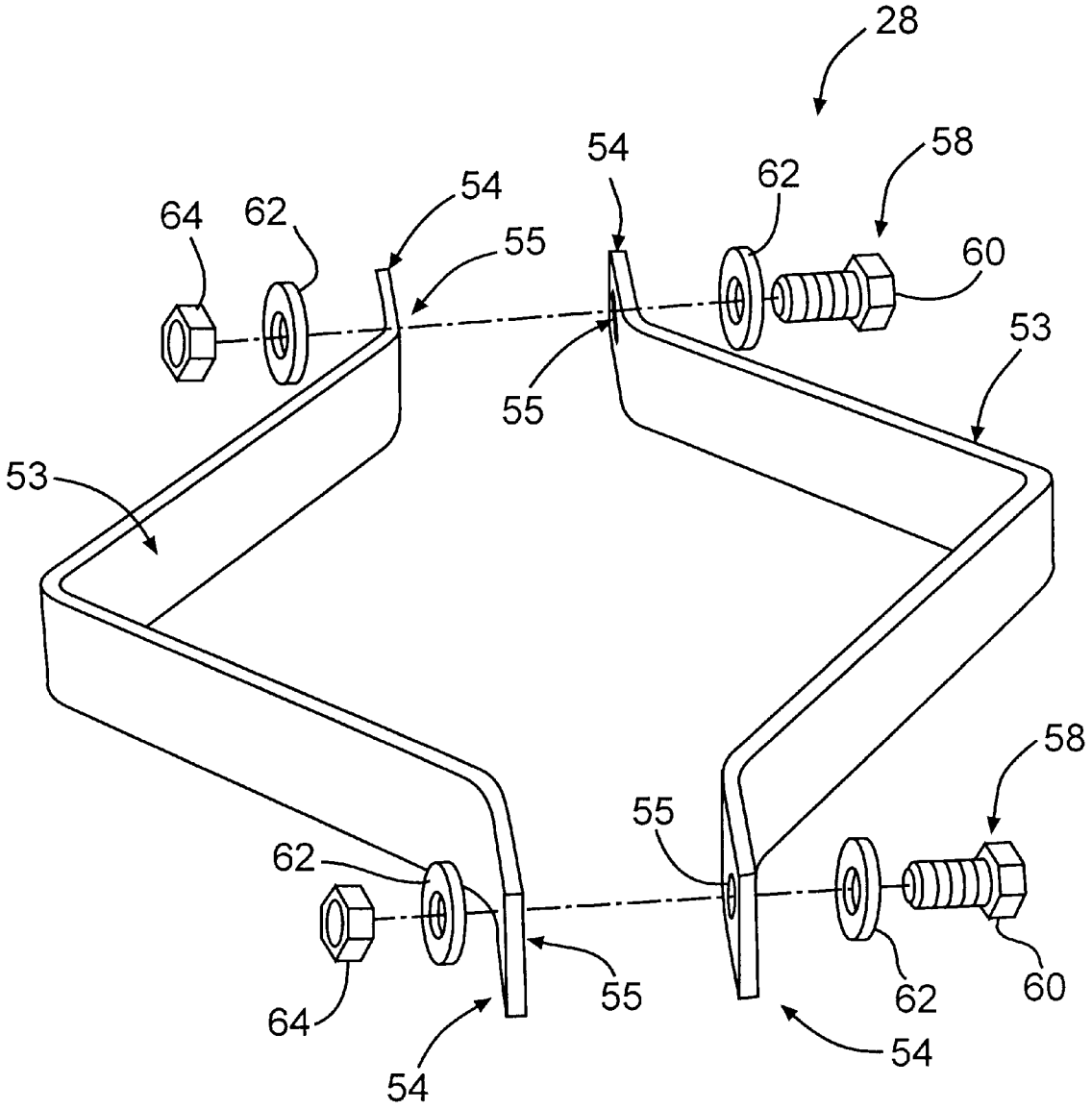
FIG. 6A is a perspective view of the clamp used in the mounting system shown in FIG. 1.
Figure 6B:
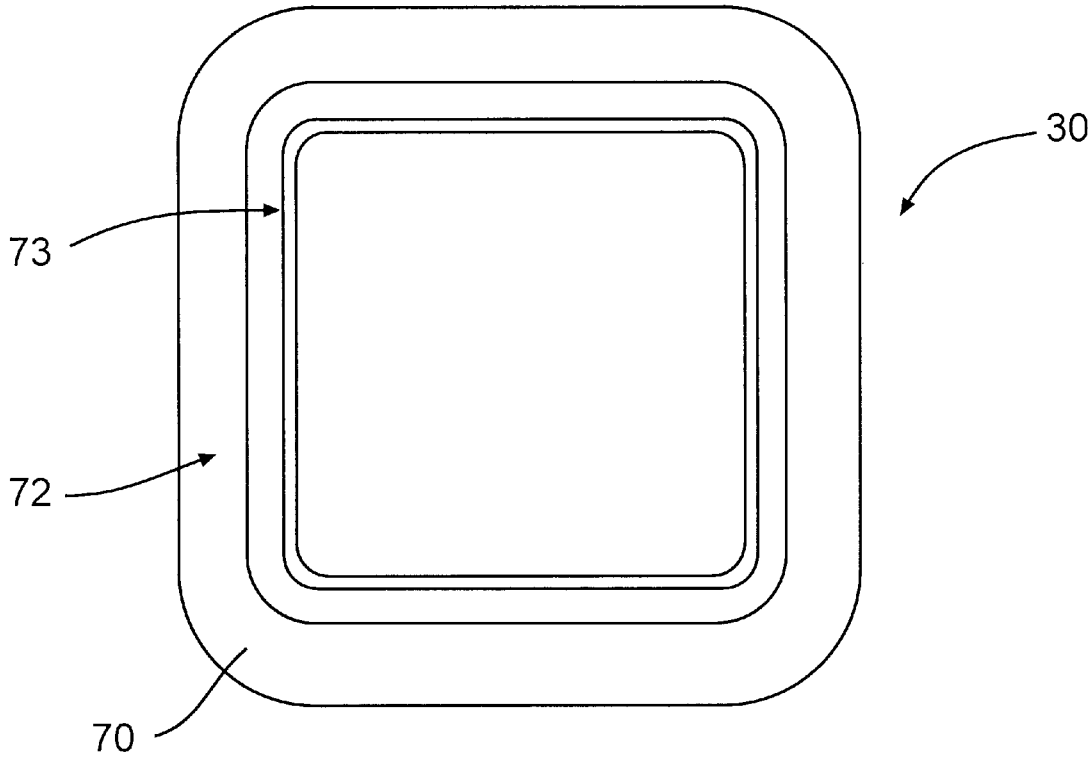
FIGS. 6B and 6C are top and partial cut-way views, respectively, of a cap that may be used with the first embodiment of the invention.
Figure 6C:
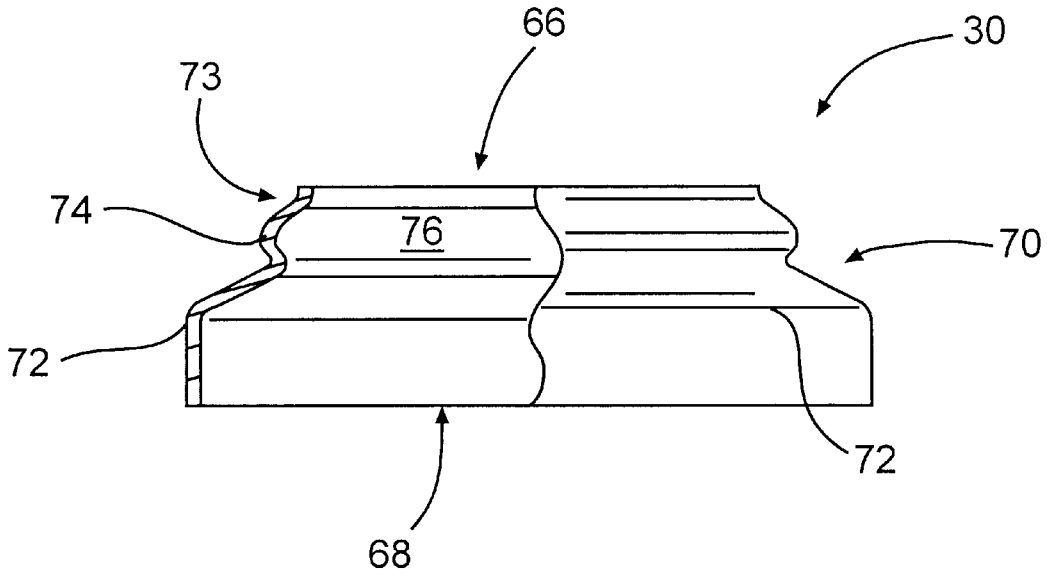

Referring now to FIGS. 6B and 6C, cap 30 will be discussed. Cap 30 has a generally square cross-sectional shape corresponding to the square shape of ground sleeve 26 and pole 12. Cap 30 is preferably formed of the same material as ground sleeve 26, as discussed in more detail below, although other materials may be used as will be recognized by a skilled artisan. Cap 30 is a hollow tubular member defined by a peripheral wall 70 having an upper open end 66 and a lower open end 68. Wall 70 is configured to be removably and readily attached to ground sleeve 26 to cover and protect clamping mechanism 28 and the exposed portion of ground sleeve 26, i.e. neck 36. In particular, wall 70 includes a snap-fit portion 73, which as shown is a peripheral rib 74 when viewed from the exterior of cap 30, and a peripheral recess 76 when viewed from the interior of cap 30. Snap-fit portion 73 is formed to have a shape complementary to protuberance 27 on neck 36 of ground sleeve 26 (FIG. 3A). Accordingly, as shown best in FIG. 2, cap 30 can be snap-fit onto neck 36 of ground sleeve 26 by slidably forcing recess 76 over and onto protuberance 27 on the exterior of ground sleeve 26. Similarly, cap 30 can be removed by pulling cap 30 away from ground sleeve 26 thereby separating protuberance 27 and recess 76.

Wall member 70 further includes a peripheral flange 72 extending radially outwardly and downwardly from rib 74. Flange 72 is of a size sufficient to cover clamping mechanism 28 and the portion of ground sleeve 26 that remains above cement 29, i.e. neck 36. Accordingly cap 30 protects metal clamping mechanism 28 from the weather, accidental interference, as well as offering aesthetic appeal.

Figure 6D:
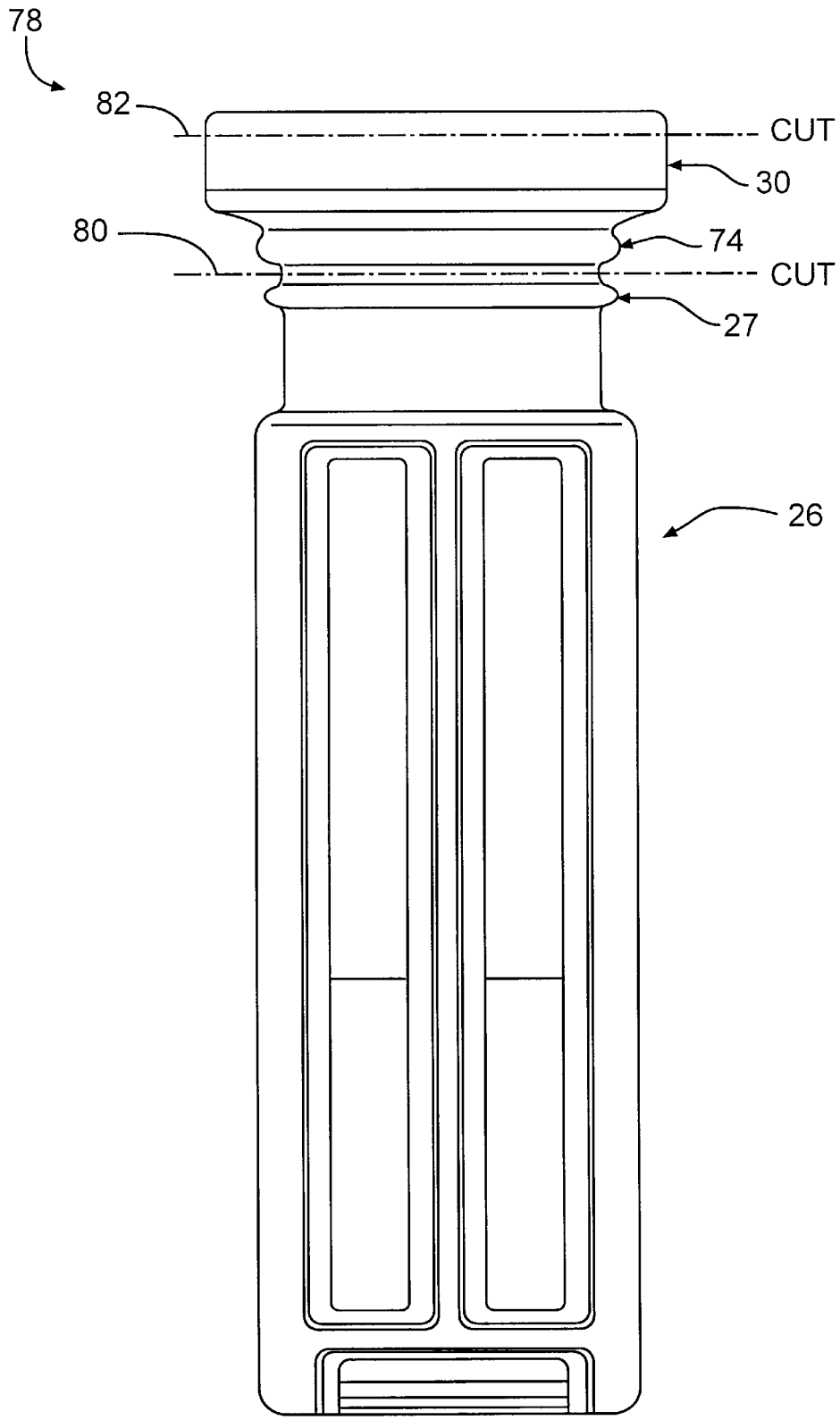
FIG. 6D is a side view of a unitary blow-molded part from which the ground sleeve and the cap of the first embodiment of the invention may be made.
Figure 6E:
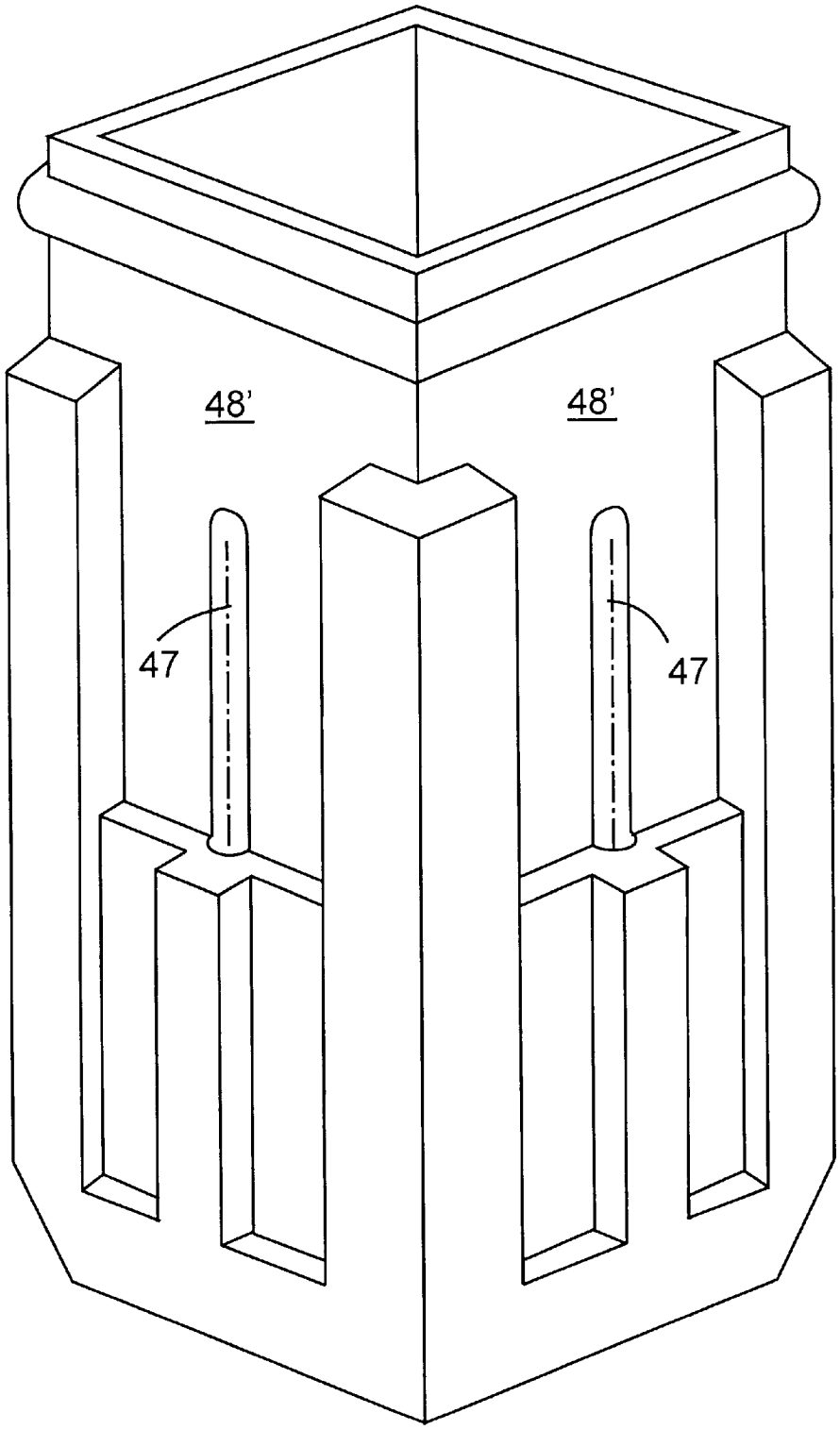
FIG. 6E is a perspective view of an alternate embodiment of a ground sleeve having pole supports that may be employed in the first embodiment of the invention.

In one preferred method of making the invention, ground sleeve 26 and cap 30 described above may be formed as a unitary molded part, as shown generally at 78 in FIG. 6D, by a conventional blow-molding process. After molding, molded part 78 is cut at cut-line 80 to separate cap 30 from ground sleeve 26 and create open end 66 in cap 30 and open end 34 in ground sleeve 26. As illustrated in FIG. 6D, cap 30 is in inverted position from that shown in FIGS. 1, 2, and 6C. Cap 30 is also cut at cut-line 82 to form lower open end 68. Recess 76 formed by rib 74 on cap 30 and protuberance 27 on ground sleeve 26, which are snap-fit together to connect cap 30 and ground sleeve 26, may be integrally formed as part of molded part 78 during the molding process. Other features of ground sleeve 26 and cap 30 discussed above may also be integrally formed during the molding process. Relief grooves 40 may be cut into neck 36 of ground sleeve 26 using any appropriate tool, such as a saw. Of course, other methods may be used to make these parts as will be apparent to the skilled artisan.

One method of installing mounting system 24 in accordance with the invention is to position pole section 12*c* into ground sleeve 26 and clamp ground sleeve 26 to pole section 12*c* using clamping mechanism 28. Then, pole section 12*c* and ground sleeve 26 may be positioned in a hole in ground 33 and filled with cement 29 up to approximately shoulder 42 of ground sleeve 26. Pole section 12*c* is used to level ground sleeve 26. After cement 29 has set or hardened, clamping mechanism 28 may be unclamped to release pole section 12*c* so that it may be removed from ground sleeve 26. Then, pieces 12*a*, 12*b*, and 12*c* of pole 12 are assembled and pole 12 is filled with concrete. Goal system 15 is mounted on upper end 20 of pole 12 and cap 30 is slipped over lower end 17 of pole 12. Then pole 12 is reinserted into ground sleeve 26. Clamping mechanism 28 is again secured on neck 36 of ground sleeve 26, which is now set in the hardened cement 29 in ground 33. Clamping mechanism 28 is tightened on neck 36 of ground sleeve 26 until pole 12 is secured therein. Finally, cap 30 is snap-fit onto ground sleeve 26. When desired, pole 12 can be simply removed from mounting system 24 by removing cap 30, loosening the clamping mechanism 28 and sliding pole 12 out of ground sleeve 26.

A Second Embodiment of the Invention

Referring now to FIGS. 7–11, another embodiment of a mounting system in accordance with the invention is shown generally at 100, which would be used in conjunction with pole 12 and goal and net assembly 15 described above, or similar equipment. In comparison to mounting system 24, mounting system 100 is defined by a two-piece ground sleeve 102, a two-piece cap 104 and has a different mechanism for securing pole 12 than that discussed above. However, this embodiment is not limited to a two-piece construction, just as the first embodiment is not limited to a unitary construction.

Mounting system 100 generally includes ground sleeve 102 and deformable cap 104. The structure of ground sleeve 102 and cap 104 will first be discussed in detail, then the assembly and use of mounting system 100 with pole 12 will be described.

Figure 7:
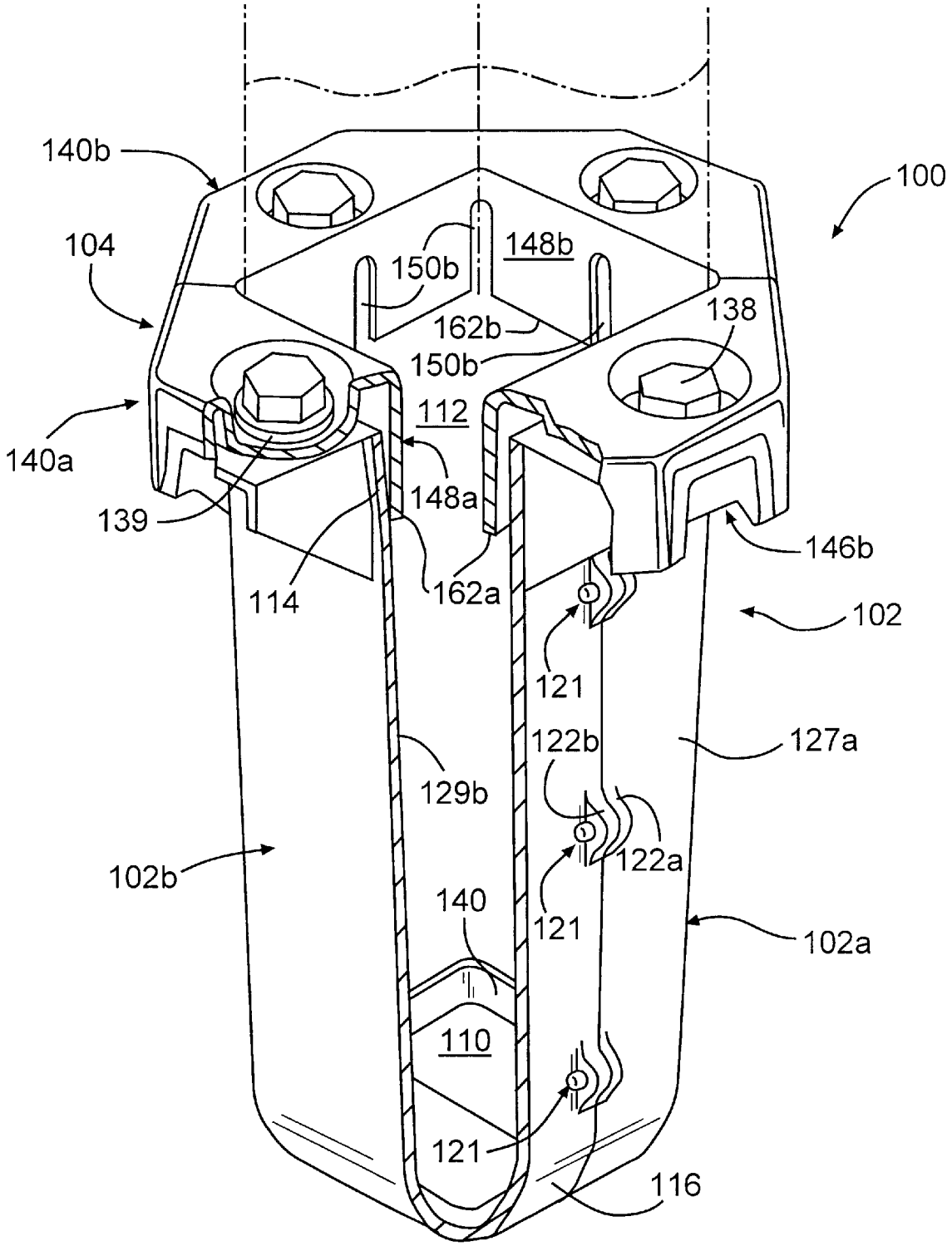
FIG. 7 is a perspective partial cut-away view of a second embodiment of a mounting system constructed according to the principles of the invention.
Figure 8:
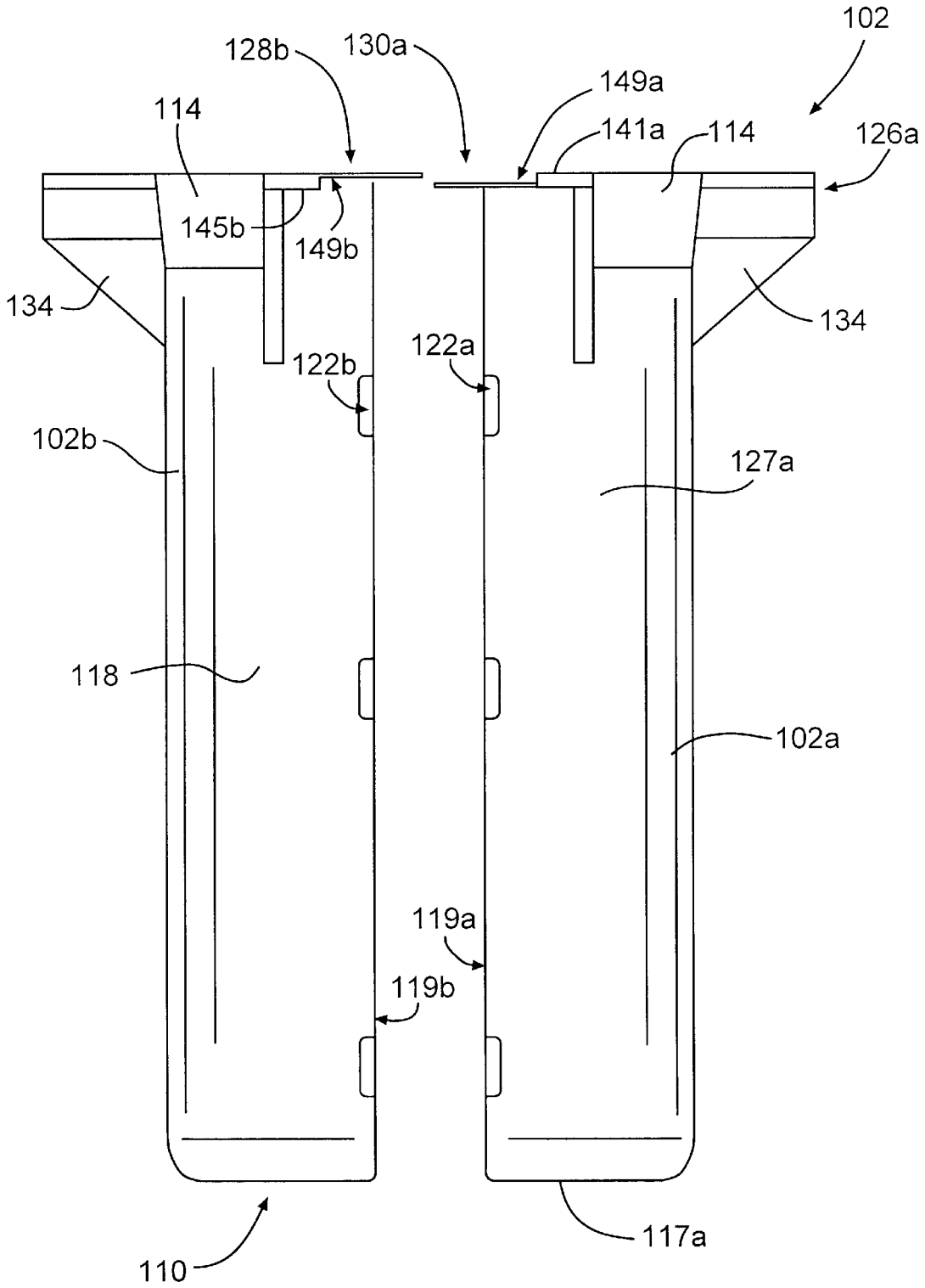
FIG. 8 is a side view of the ground sleeve shown in the mounting system of FIG. 7 illustrating the two halves that form the ground sleeve.
Figure 9:
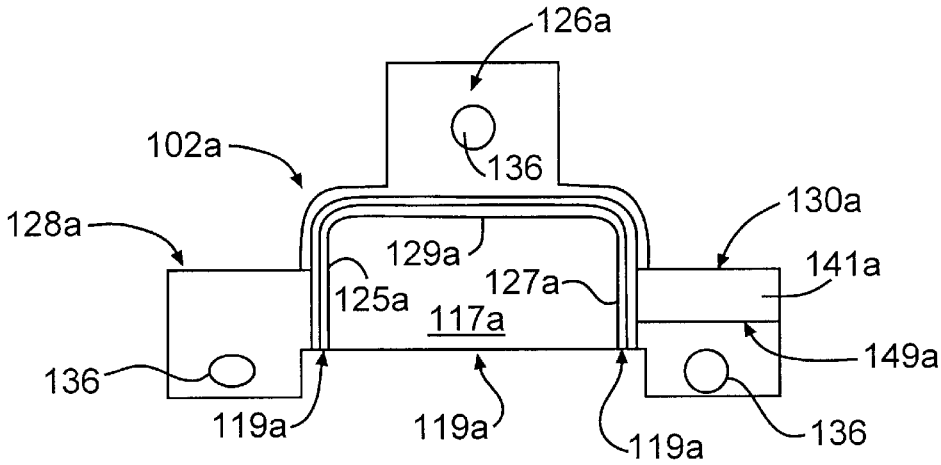
FIG. 9 is a top view of one-half of the ground sleeve shown in FIG. 8.

Referring to FIGS. 7–9, ground sleeve 102 has an open top end 112 and a closed bottom end 110. Ground sleeve 102 has a generally square cross-section corresponding to the shape of pole 12, however, other shapes may be used as discussed earlier. Moreover, similar to the first embodiment, the interior dimensions of ground sleeve 102 may be slightly larger than the exterior dimensions of pole 12 to reduce surface contact.

Open top end 112 of ground sleeve 102 includes a camming surface 114 which is angled or tapered slightly and is used to cause cap 104 to deflect inwardly. As shown, the camming surface 114 has a taper of preferably approximately 5–10 degrees relative to a longitudinal axis of ground sleeve 102. In use, tapered camming surface 114 engages and causes cap 104 to deform inwardly as discussed in detail below. Closed bottom end 110 of ground sleeve 102 includes peripheral alignment portion 116, which functions in a similar manner as alignment portion 50.

Ground sleeve 102 may have a two-piece construction of the type having essentially identical first and second halves 102*a* and 102*b* made of polypropylene or another non-corrosive material. With such a construction, manufacture is simplified as only one piece needs to be tooled.

As halves 102*a* and 102*b* are essentially identical, only piece 102*a* will be described in detail, as the construction of half 102*b* is readily apparent from the discussion of half 102*a*. As best shown in FIGS. 7 and 9, ground sleeve half 102*a* has one full width side wall 129*a* and partial width side walls 125*a* and 127*a*, which are substantially parallel to each other and perpendicular to side wall 129*a*. Bottom wall 117*a* is perpendicular to walls 125*a*, 127*a*, 129*a*. Partial side walls 125*a*, 127*a* and bottom wall 117*a* have side and bottom edges 119*a,* which abut against complementary side and bottom edges on half 102*b* when halves 102*a*, 102*b* are assembled.

A full width flange 126*a* extends perpendicularly from side wall 129*a* and preferably has a constant thickness. As shown in FIG. 9, half 102*a* has two flanges 128*a*, 130*a* extending perpendicularly from side walls 125*a* and 127*a*, respectively, for mating with a pair of complementary overlapping flanges on half 102*b* (only one of which is shown in FIG. 8). Flange 130*a* on half 102*a* is shown in FIG. 8 aligned with corresponding overlapping flange 128*b* on half 102*b*. Although not shown, it is apparent that flange 128*a* on 102*a* would be aligned with flange 130b on 102*b* at the same time. As illustrated in FIG. 8, upon connection of halves 102*a* and 102*b*, notch 149*a* in upper surface 141*a* of flange 130*a* receives complementary flange 128*b*, while notch 149*b* in lower surface 145*b* of flange 128*b* receives complementary flange 130*a*. A similar relationship occurs with the unillustrated flanges 128*a* and 130*b* in FIG. 8.

Referring again to FIG. 9, flanges 126*a*, 128*a* and 130*a* are adapted to be mechanically connected to cap 104. In particular, flanges 126*a*, 128*a* and 130*a* include apertures 136 for receiving a connector such a bolt 138 (FIG. 7). When halves 102*a*, 102*b* are assembled together, flanges 128*a*, 130*a* on half 102*a* overlap with corresponding flanges 130*b*, 128*b*, respectively on half 102*b* such that the apertures 136 in the overlapped flanges align to produce an assembled ground sleeve 102 with a set of 4 flanges extending around and outwardly from the body of ground sleeve 102, with each flange having one aperture 136 for receiving a bolt 138.

As shown in FIGS. 7 and 8, edges 119*a* on half 102*a* have three tabs 122*a* and corresponding edges 119*b* on half 102*b* have three tabs 122*b* for use in securing halves 102*a*, 102*b* to each other. Tabs 122*a*, 122*b* have openings 121 (FIG. 7) capable of receiving a mechanical connector (not shown) such as a screw assembly. To assemble halves 102*a*, 102*b*, openings 121 in tabs 122*a*, 122*b* are aligned and secured by mechanical connectors.

Flanges 126*a*, 128*a*, 130*a*, which will bear much of the force caused by lateral movement of pole 12 and goal assembly 15 during use, may be reinforced using gussets 134 (FIG. 8). In particular, gussets 134 extend between flanges 126*a*, 128*a* and 130*a* and respective side walls 125*a*, 127*a*, 129*a* on half 102*a*.

Figure 10:
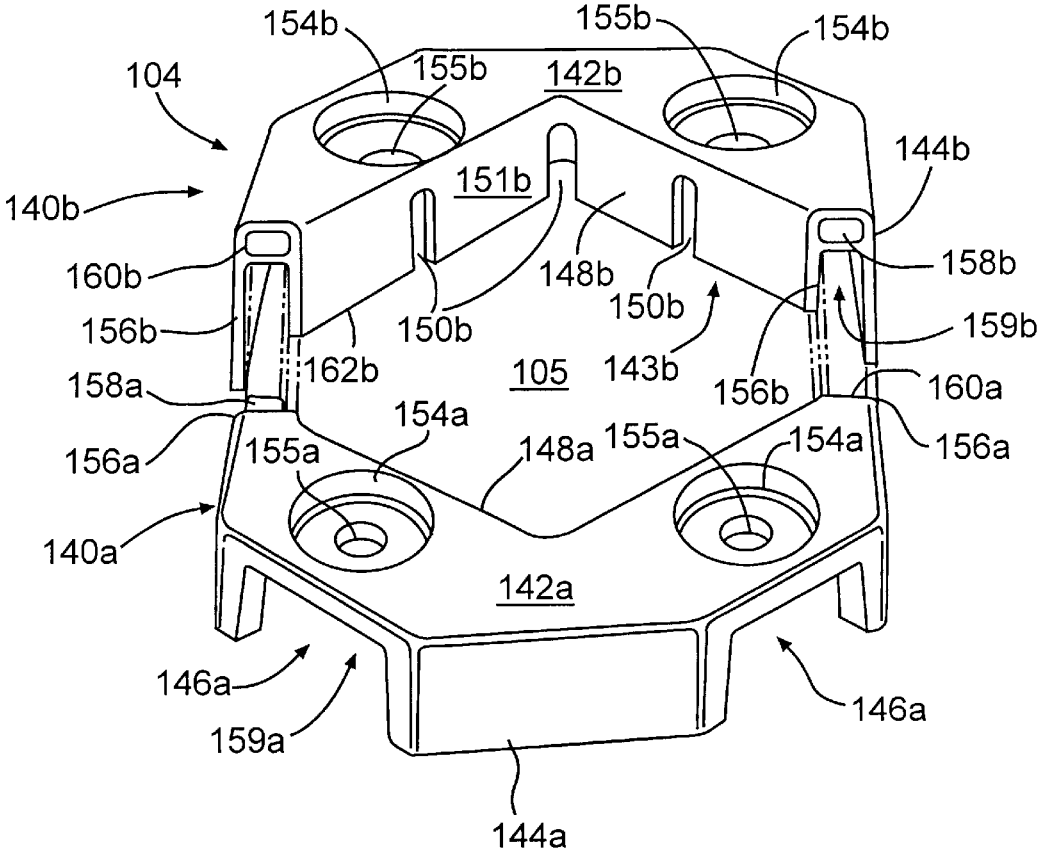
FIG. 10 is a perspective view of the cap shown in FIG. 7 illustrating the two halves that form the cap being separated.

As shown in FIG. 10, cap 104 includes a first half 140*a* and a second half 140*b*, which are essentially identical to each other. When assembled, cap 104 has a central opening 105 generally corresponding in shape and size to opening in top end 112 of ground sleeve 102. Halves 140*a* and 140*b* have a respective top surface 142*a*, 142*b*, an exterior skirt 144*a*, 144*b* extending substantially perpendicular and downwardly from top surface 142*a*, 142*b*, and an interior skirt 148*a*, 148*b* extending substantially perpendicular and downwardly from top surface 142*a*, 142*b*. Top surfaces 142*a*, 142*b*, exterior skirts 144*a*, 144*b*, and interior skirts 148*a*, 148*b* define a respective, variable width channel 159*a*, 159*b* underneath top surfaces 142*a*, 142*b* adapted to receive the flanged upper end of ground sleeve 102. As shown best in FIG. 7, the flanges 126, 128 and 130 on the upper end of ground sleeve 102 are received within the channels 159*a* or 159*b* and abut the underside of top surfaces 142*a*, 142*b* on cap 104 as it is secured onto ground sleeve 102.

Top surfaces 142*a*, 142*b* of cap 104 may each include a pair of recesses 154*a*, 154*b* and apertures 155*a*, 155*b* formed therein to accommodate a mechanical connector such as a bolt 138 (FIG. 7) or similar fastener. Apertures 155*a*, 155*b* are disposed such that during assembly they are substantially co-axially alignable with apertures 136 in ground sleeve 102. For example, bolts 138 may be passed through apertures 155*a*, 155*b* and a washer 139 and the head of bolt 138 may be disposed in recesses 154*a*, 154*b* such that the mechanical connectors do not protrude above the plane of top surfaces 142*a,* 142*b*.

Figure 11:
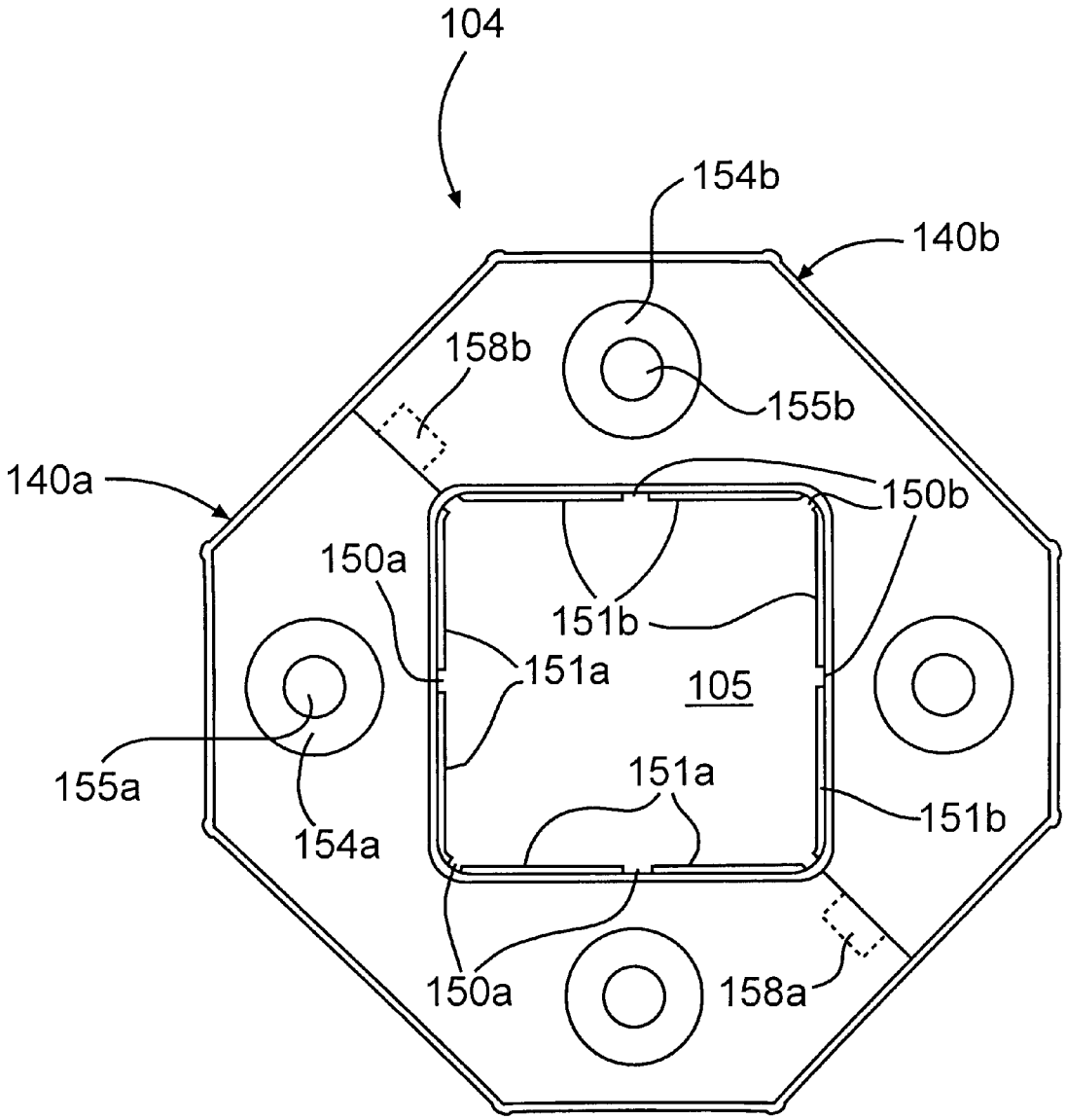
FIG. 11 is a top view of the cap of FIG. 10 with the halves assembled together.
Figure 12:
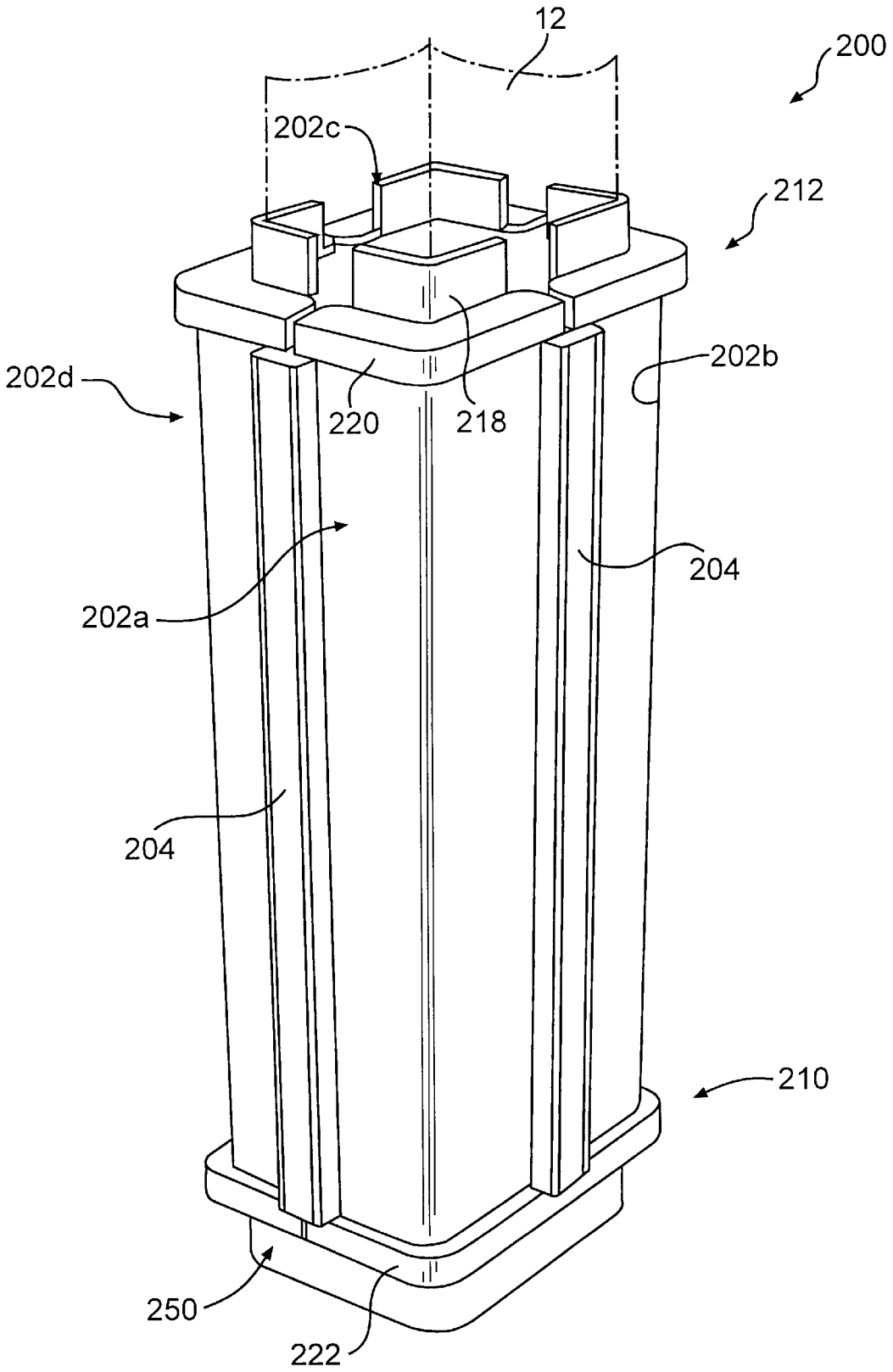
FIG. 12 is a perspective view of a third embodiment of the invention employing a four-piece ground sleeve.

Exterior skirts 144*a*, 144*b* each have a pair of openings 146*a*, 146*b,* which provide for wrench access such that bolt 138 can be tightened to secure cap 104 to ground sleeve 102 as discussed in greater detail herein. Interior skirts 148*a*, 148*b* include relief grooves 150*a*, 150*b* (FIGS. 7, 10–11) extending along the longitudinal axis of mounting system 100 and which terminate at edges 162*a*, 162*b* (FIGS. 7, 10) of interior skirts 148*a*, 148*b*. Relief grooves 150*a*, 150*b* form deformable tabs 151*a*, 151*b* in the interior skirt 148*a*, 148*b*, thereby increasing the flexibility of interior skirts 148*a*, 148*b* so that they may deform inwardly. Side edges 156*a*, 156*b* (FIG. 10) on cap halves 140*a*, 140*b* have male connectors 158*a*, 158*b* and female connectors 160*a*, 160*b*, respectively. Accordingly, when first and second halves 140*a*, 140*b* are assembled, the male and female connectors 158*a*, 158*b*, 160*a*, 160*b* mechanically engage to lock the halves 140*a*, 140*b* together, such as by a snap fit, as illustrated in FIG. 11. Of course, other means known in the art for connecting the halves may be employed.

In use, pole 12 is inserted into ground sleeve 102 and cap 104 is slidably disposed over pole 12 and onto open top end 112 of ground sleeve 102 such that the interior skirts 148*a*, 148*b* engage the camming surface 114 as shown on the left side of the cut-away portion in FIG. 7. By tightening bolts 138 passing through ground sleeve 102 and cap 104, tabs 151*a*, 151*b* of interior skirts 148*a*, 148*b* deform inwardly as they are forced against inclined camming surface 114. In particular, as tabs 151*a*, 151*b* of interior skirts 148*a*, 148*b* continue to deflect inwardly they wedge between the interior of ground sleeve 102 and the exterior of pole 12 thereby securing pole 14 within mounting system 100 with an interference fit.

A method of installing a basketball system in accordance with the second embodiment of the invention will now be described. To begin, first and second ground sleeve halves 102*a*, 102*b* are assembled by aligning and fastening tabs 122*a* with tabs 122*b* using, for example, bolts (not shown). Pole section 12*c* is used as discussed earlier to position ground sleeve 102 in cement 29. Accordingly, pole section 12*c* is slid through open top end 112 of ground sleeve 102 until it rests on abutment portion 116. End cap 104 may be slid over pole section 12*c* and aligned in ground sleeve 102 using bolts 138. Cap 104 is tightened onto ground sleeve 102 causing pole section 12*c* to be secured in mounting system 100. Then this partially assembled unit is sunk into the wet cement up to the lower edge of exterior skirts 144*a*, 144*b* of cap 104 so that the connectors remain accessible via openings 146*a*. Once cement 29 has set, which usually takes up to 24 hours, bolts 138 are loosened and cap 104 and pole 12 are removed. Pole 12 is then assembled in accordance with conventional practice and may be filled with concrete to improve stability and rigidity. Then pole 12 is reinserted into and re-secured to mounting system 100 as previously described.

A Third Embodiment of the Invention

In another embodiment of the invention, illustrated in FIGS. 12–15, a 4-piece ground sleeve is shown generally at 200. Ground sleeve 200 includes four essentially identical, angled quarter-sections 202*a*, 202*b*, 202*c*, and 202*d*.

An advantage of this embodiment of the invention is that four-piece ground sleeve 200 can be easily shipped in a compact arrangement by nesting or stacking (not shown) quarter-sections 202*a*, 202*b*, 202*c* and 202*d* on top of each other to form a compact shipping arrangement. Once nested, quarter-sections 202*a*, 202*b*, 202c, and 202*d* may be stored inside one of the pole sections 12*a*, 12*b*, or 12*c* during shipping. Then, quarter-sections 202*a*, 202*b*, 202*c* and 202*d* can be easily assembled using elongated strip clips 204 as discussed below. When assembled, quarter-sections 202*a*, 202*b*, 202*c*, and 202*d* form an upper open end 212 and a lower open end 210, which is shown closed by a conventional square cap 250 as shown in FIG. 16. A clamping mechanism of the type discussed earlier may be used to secure the pole in ground sleeve 200.

Because quarter-sections 202*a*, 202*b*, 202*c*, and 202*d* are essentially identical, only section 202*a* is described below as the description of section 202*a* applies equally to other quarter-sections 202*b*, 202*c* and 202*d*. Section 202*a* may be made of a rigid plastic material or other preferably non-corrosive materials of suitable strength and rigidity as will be apparent to a skilled artisan. Section 202*a* is a substantially elongated member having sidewall 206 and sidewall 208 (FIG. 15) extending substantially perpendicular to each other. At longitudinal edges 214 of sidewalls 206, 208, clip attachment nubs 215 are formed along the length of section 202*a*. Reinforcement flanges 220, 222 (FIG. 12) are formed at the upper and lower open ends 210, 212 of ground sleeve 200 to improve the structural rigidity of section 202*a*. A neck portion 218 extends upwardly from the corner of sidewalls 206, 208, at the upper open end 210 of ground sleeve 200. A bottom downwardly extending flange 219 (FIG. 14) of similar construction to neck portion 218 is formed in the corner of side walls 206, 208 at the lower open end 212 (not shown) of ground sleeve 200 to receive cap 250. Cap 250 may be friction fit onto ground sleeve 200.

Figure 15:
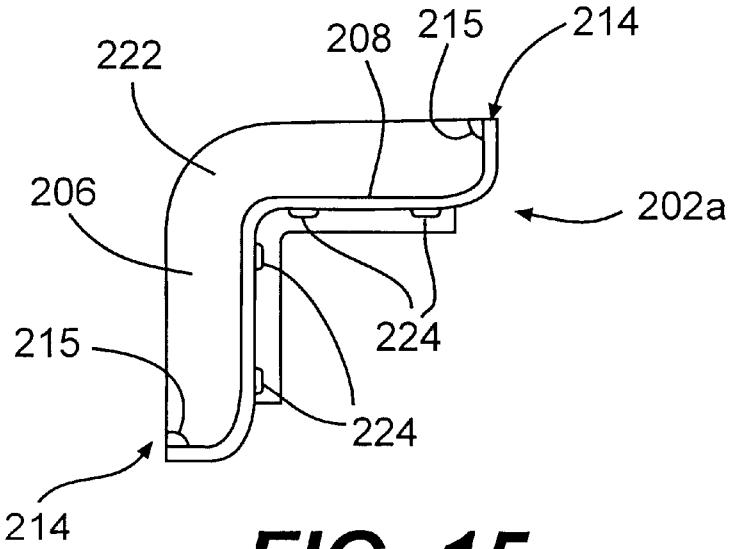
FIG. 15 is a cross-sectional view taken along line 15—15 in FIG. 14.
Figure 17:
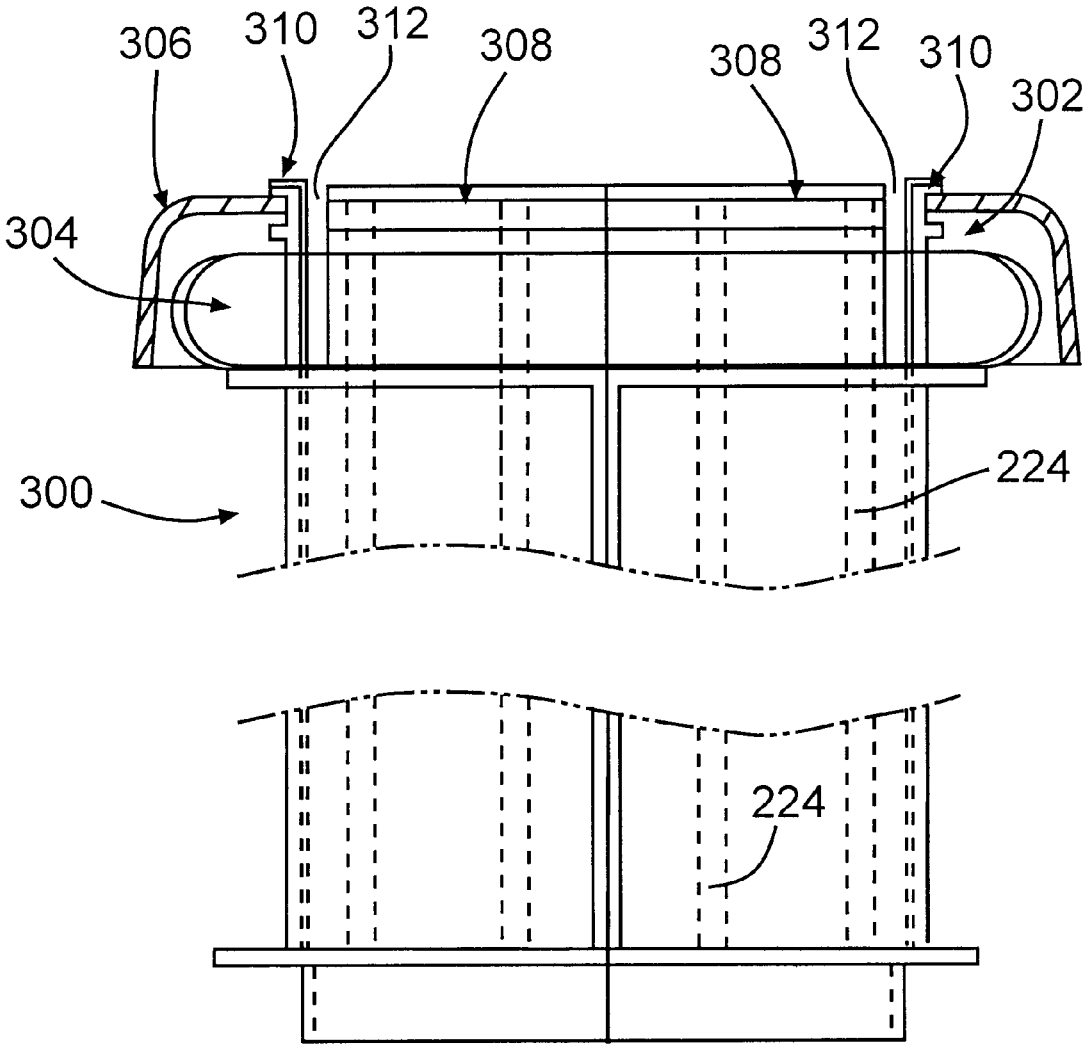
FIG. 17 is a side and partial cross-sectional view of a modified embodiment of the four-piece ground sleeve shown in FIG. 12.

As shown in FIG. 15, the interior surface of section 202*a* includes elongated, spaced apart ribs 224 extending along the length of the interior surface of section 202*a*. The ribs 224 as shown extend outwardly from the interior surface of side walls 206, 208 about 1/8–1/4", for example. Elongated ribs 224 space pole 12 from the interior surface of side walls 206, 208 to reduce the amount of surface contact between ground sleeve 200 and pole 12 thereby reducing surface friction and facilitating pole removal.

Figure 13:
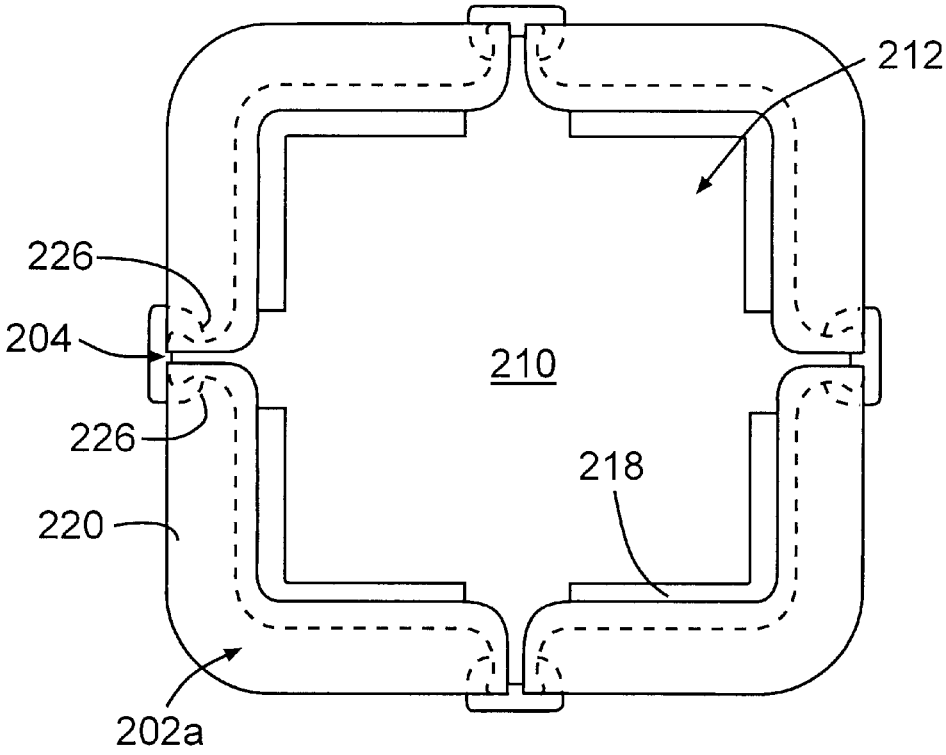
FIG. 13 is a top view of the mounting system shown in FIG. 12.

Clips 204 illustrated from the top view in FIG. 13 are of a generally U-shaped configuration having inwardly bent ends 226. Clips 204 are snap-fit onto quarter-sections 202*a*, 202*b*, 202*c*, and 202*d* of ground sleeve 200 such that bent ends 226 on clips 204 extend around and engage nubs 215 on adjacent quarter-sections 202*a*, 202*b*, 202*c*, 202*d*, respectively. Accordingly, clips 204 may be made of any semi-rigid elastic material, which is preferably non-corrosive. Once the ground sleeve is assembled, pole 12 and ground sleeve 200 may be installed in a manner similar to that discussed above.

A Fourth Embodiment of the Invention

FIGS. 17–20 illustrate an alternate embodiment of the four-piece ground sleeve embodiment discussed above. In this embodiment of the invention, a ground sleeve is shown generally at 300 and has substantially the same quarter-section construction as ground sleeve 200. However, the upper end of ground sleeve 300 has been modified to incorporate the use of cap 306, which may have relief grooves in accordance with the first embodiment of the invention. Of course, other types of clamping mechanisms, caps and relief structures may be employed without departure from the principles of the invention. Accordingly, in use, clamping mechanism 304 (schematically shown in FIG. 17) can be tightened onto neck 302 to secure ground sleeve 300 to pole 12 and cap 306 can be snap-fit onto ground sleeve 300 similar to the first embodiment of the invention. Only those features of ground sleeve 300 which may not be readily apparent from the description above are discussed herein.

Figure 18:
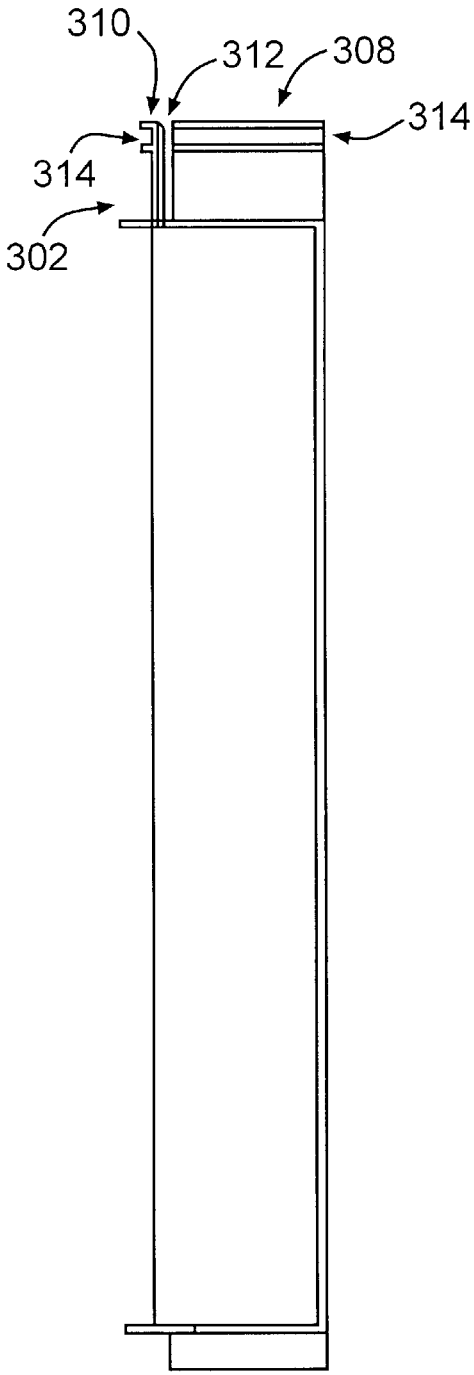
FIG. 18 is a side view of one section of the four-piece ground sleeve shown in FIG. 17.
Figure 19:
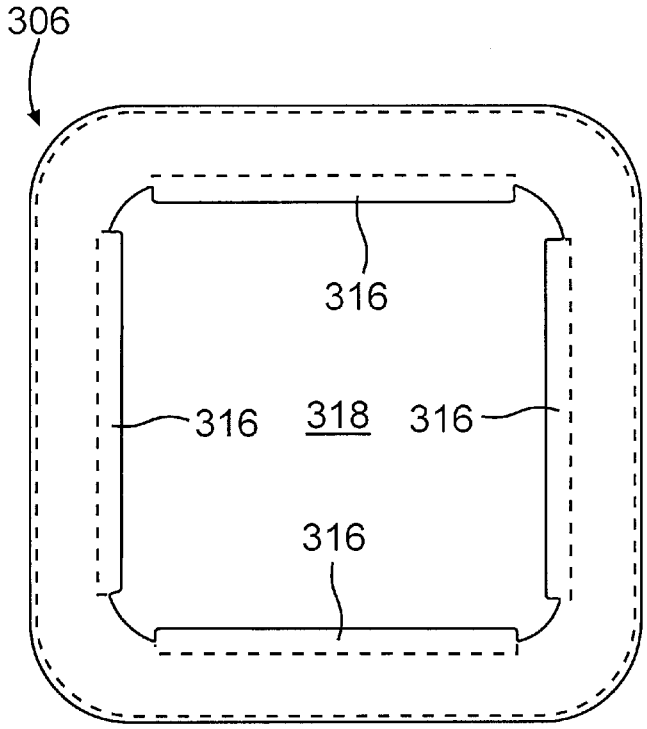
FIGS. 19 and 20 are top and side views of the end cap shown in FIG. 17.
Figure 20:
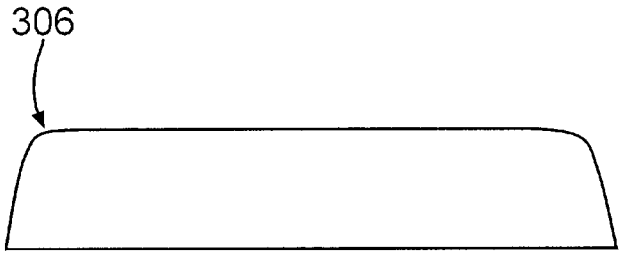

Referring to FIG. 18, each section of ground sleeve 300 includes upper flanges 308, 310 separated by a relief groove 312, which increases the deformability of neck 302. Each flange 308, 310 includes a lateral recess or channel 314 on its exterior side for mating with corresponding structure on cap 306 for securing cap 306 thereto. In particular, cap 306 has lateral flanges 316 extending inwardly and which are adapted to snap-fittingly engage with channels 314 on neck 302 of ground sleeve 300. Once the ground sleeve is assembled, pole 12 and ground sleeve 300 may be installed in a manner similar to the other embodiments discussed above.

What is claimed is:

1. An in-ground basketball system comprising:

a basketball support pole having spaced-apart ends;

a basketball backboard attached at or near to one of the ends of said basketball support pole;

a basketball rim attached to said backboard; and a mounting structure to support said basketball support pole by inserting the other end of said basketball support pole into said mounting structure, wherein said mounting structure comprises:

a sleeve having a first opening of a first predetermined size for receiving said basketball pole;

a cap having a second opening of a second predetermined size for receiving said basketball support pole, said cap being engageable substantially about said sleeve; and at least one relief structure disposed in one of said sleeve and said cap, said relief structure providing flexibility permitting deformation to adjust one of said first and said second predetermined sizes.

2. An in-ground basketball system according to claim 1, wherein said at least one relief structure comprises at least one of a groove, notch, and reduced thickness portion.

3. An in-ground basketball system according to claim 1, wherein said at least one relief structure is in said sleeve.

4. An in-ground basketball system according to claim 1, wherein said at least one relief structure is in said cap.

5. An in-ground basketball system according to claim 3, further comprising a clamp engageable with said sleeve to adjust said first predetermined size, whereby the mounting structure is adapted to firmly secure said basketball support pole.

6. An in-ground basketball system according to claim 4, wherein said sleeve has a longitudinal axis and a camming surface inclined with respect to the longitudinal axis, said cap being engageable with said camming surface to adjust said second predetermined size.

7. An in-ground basketball system according to claim 1, further comprising a connector to removably secure said cap to said sleeve.

8. An in-ground basketball system according to claim 1, wherein the first and second openings are shaped to receive said basketball support pole.

9. An in-ground basketball system according to claim 8, wherein the first opening generally forms the shape of one of a square, a rectangle, a circle, an oval, and a pear-shape, and the second opening generally forms the shape of one of a square, a rectangle, a circle, an oval, and a pear-shape.

10. An in-ground basketball system according to claim 1, wherein said sleeve comprises four sections interconnected with each other.

11. An in-ground basketball system according to claim 7, wherein said connector comprises a protuberance provided on one of said sleeve and said cap and a recess provided on the other of said sleeve and said cap, said protuberance and said recess being snap fit to secure said cap and sleeve together in fixed, but removable engagement.

12. An in-ground basketball system according to claim 1, wherein said sleeve has spaced portions to guide and support said basketball support pole in said sleeve.

13. An in-ground basketball system according to claim 12, wherein said sleeve includes sidewalls and said spaced portions extend inwardly from said sidewalls.

14. An in-ground basketball system according to claim 13, wherein said sleeve has a closed end opposite the first opening and said spaced portions include a tapered portion extending inwardly from said closed end.

15. An in-ground basketball system according to claim 1, wherein said sleeve has a body portion, a neck portion at the first opening, and a shoulder connecting said body and neck portion, said neck having a first interior size and said body portion having a second interior size larger than said first interior size.

16. An in-ground basketball system according to claim 1, wherein said sleeve has an interior surface and only a fraction of the interior surface is adapted to contact an exterior surface of said basketball support pole.

17. An in-ground basketball system according to claim 1, wherein said sleeve comprises two separate pieces that are locked together.

18. An in-ground basketball system according to claim 1, wherein the cap comprises two separate pieces that are locked together.

19. A ground sleeve for supporting a basketball pole of an in-ground basketball system, said ground sleeve comprising:

a hollow body with spaced-apart ends including a longitudinal axis and sidewalls, wherein said sidewalls define a cross-section in a plane transverse to the longitudinal axis, and wherein said sidewalls are of variable thickness permitting deformation;

an opening of predetermined size in one of the ends, wherein said opening is configured to receive a basketball support pole and a clamping mechanism engageable with the ground sleeve to adjust the size of the predetermined opening.

20. A ground sleeve according to claim 19, further comprising at least one relief structure facilitating deformation of said sidewalls.

21. A ground sleeve according to claim 20, wherein said relief structure comprises at least one of a groove, a notch and a reduced thickness portion.

22. A ground sleeve according to claim 20, wherein the cross-section has at least one corner and said relief structure includes a pair of relief grooves at said corner.

23. A ground sleeve according to claim 19, further comprising:

a cap removably connectable to the ground sleeve for covering a portion of the ground sleeve and said clamping mechanism, wherein said opening comprises a first opening and said cap has a second opening for receiving the basketball support pole.

24. A ground sleeve according to claim 19, wherein said hollow body of said ground sleeve includes a portion longitudinally spaced from the cross-section and engageable with the basketball support pole.

25. A ground sleeve according to claim 24, wherein said hollow body forms an interior cavity and said longitudinally spaced portion of the hollow body includes at least one projection extending inwardly into the interior cavity.

26. A ground sleeve according to claim 25, wherein said at least one projection comprises a plurality of projections disposed circumferentially about said hollow body of the ground sleeve.

27. A ground sleeve according to claim 19, wherein one of said ends is closed and said closed end has a pole aligning portion.

28. A ground sleeve according to claim 27, wherein said pole aligning portion comprises an angled wall.

29. A ground sleeve according to claim 19, wherein the cross-section of said hollow body is generally one of a square, circular, oval, and pear shape.

30. A ground sleeve according to claim 19, wherein said hollow body forms an interior cavity and includes pole abutment portions extending inwardly into said interior cavity.

31. A ground sleeve according to claim 19, wherein said hollow body has indentations configured to receive cement to aid in anchoring and preventing rotation of the ground sleeve when installed.

32. A ground sleeve according to claim 19, wherein said hollow body comprises a plurality of separate sections interconnected to form the ground sleeve.

33. A ground sleeve according to claim 32, wherein said sections are substantially identical and nestable to form a compact configuration for shipping.

* * * * *